US008485514B2

(12) United States Patent
Sugiyama et al.

(10) Patent No.: US 8,485,514 B2
(45) Date of Patent: Jul. 16, 2013

(54) SHEET PROCESSING APPARATUS, IMAGE FORMING SYSTEM, AND SHEET PROCESSING METHOD

(75) Inventors: Keisuke Sugiyama, Tokyo (JP); Tomohiro Furuhashi, Kanagawa (JP); Masahiro Tamura, Kanagawa (JP); Shuuya Nagasako, Kanagawa (JP); Yuusuke Shibasaki, Kanagawa (JP); Kyosuke Nakada, Kanagawa (JP); Kazuya Yamamoto, Kanagawa (JP); Junya Suzuki, Miyagi (JP); Kazunori Konno, Miyagi (JP); Yasuo Niikura, Miyagi (JP); Tomomichi Hoshino, Kanagawa (JP); Akira Kunieda, Tokyo (JP); Takahiro Watanabe, Kanagawa (JP); Tomohiro Yoshizaki, Saitama (JP); Kiichiro Goto, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/316,916

(22) Filed: Dec. 12, 2011

(65) Prior Publication Data

US 2012/0153556 A1 Jun. 21, 2012

(30) Foreign Application Priority Data

Dec. 15, 2010 (JP) ..... 2010-279568
Feb. 28, 2011 (JP) ..... 2011-042619

(51) Int. Cl.
*B65H 37/04* (2006.01)

(52) U.S. Cl.
USPC ..... 270/58.09; 270/58.11; 399/410

(58) Field of Classification Search
USPC ..... 270/58.08, 58.09, 58.11, 58.17; 399/410
See application file for complete search history.

(56) References Cited

U.S. PATENT DOCUMENTS

| | | | |
|---|---|---|---|
| 5,692,411 | A | 12/1997 | Tamura |
| 6,145,825 | A | 11/2000 | Kunihiro et al. |
| 6,199,853 | B1 | 3/2001 | Andoh et al. |
| 6,296,247 | B1 | 10/2001 | Tamura et al. |

(Continued)

FOREIGN PATENT DOCUMENTS

| | | | |
|---|---|---|---|
| JP | 2006036480 | A | 2/2006 |
| JP | 4774362 | B2 | 7/2008 |
| JP | 2009208855 | A * | 9/2009 |
| JP | 2009263127 | A | 11/2009 |

OTHER PUBLICATIONS

Abstract of JP 2008-156073 published Jul. 10, 2008.
Abstract of JP 2009-263127 published Nov. 12, 2009.

(Continued)

*Primary Examiner* — Patrick Mackey
(74) *Attorney, Agent, or Firm* — Harness, Dickey & Pierce, P.L.C.

(57) ABSTRACT

A sheet processing apparatus includes: a sheet stacking unit on which sheets are accommodated and stacked as a sheet bundle; an aligning member that is movable along a trailing end, in a conveying direction, of the sheet bundle stacked on the sheet stacking unit and that aligns the trailing end of the sheet bundle in the sheet conveying direction by abutting thereon; a binding unit that moves along the trailing end of the sheet bundle in the sheet conveying direction and binds the aligned sheet bundle; and a moving unit that moves the aligning member in the sheet conveying direction. A distance from the trailing end of the sheet bundle in the sheet conveying direction to a binding position is adjusted by moving the aligning member in the sheet conveying direction.

12 Claims, 16 Drawing Sheets

U.S. PATENT DOCUMENTS

| | | | | |
|---|---|---|---|---|
| 6,494,449 | B2 | 12/2002 | Tamura et al. | |
| 7,988,139 | B2 | 8/2011 | Matsuura | |
| RE43,687 | E * | 9/2012 | Ohtani | 399/82 |
| 8,297,610 | B2 * | 10/2012 | Shiraishi | 270/58.09 |
| 2001/0050459 | A1 | 12/2001 | Tamura et al. | |
| 2008/0187383 | A1 * | 8/2008 | Yamamoto | 399/410 |
| 2009/0218746 | A1 | 9/2009 | Matsuura | |
| 2010/0207314 | A1 * | 8/2010 | Hattori et al. | 270/58.09 |
| 2010/0219576 | A1 * | 9/2010 | Yamamoto | 270/58.08 |
| 2011/0266738 | A1 * | 11/2011 | Furuhashi et al. | 270/58.08 |

OTHER PUBLICATIONS

Abstract of JP 2006-036480 published Feb. 9, 2006.

* cited by examiner

SHEET PROCESSING APPARATUS, IMAGE FORMING SYSTEM, AND SHEET PROCESSING METHOD

CROSS-REFERENCE TO RELATED APPLICATIONS

The present application claims priority to and incorporates by reference the entire contents of Japanese Patent Application No. 2010-279568 filed in Japan on Dec. 15, 2010 and Japanese Patent Application No. 2011-042619 filed in Japan on Feb. 28, 2011.

BACKGROUND OF THE INVENTION

1. Field of the Invention

The present invention relates to a sheet processing apparatus that aligns sheet-like recording media such as sheets of paper, recording paper, transfer paper, or transparencies (simply referred to as "sheets" in the present specification) conveyed thereto and binds the sheets into a bundle, an image forming system including the sheet processing apparatus and an image forming apparatus such as a copying machine, a printer, facsimile, or a digital multifunction peripheral, and a sheet processing method implemented in the sheet processing apparatus.

2. Description of the Related Art

Conventionally, there is known a stapler-equipped device called a finisher that stacks sheets having been discharged from an image forming apparatus on a staple tray, and aligns the sheets in a conveying direction (so-called a "longitudinal direction") and a direction perpendicular to the conveying direction (so-called a "width direction"), and then staples the sheets together. When stapling the edge of sheets with the stapler, the device can change a stapling position by moving the stapler in the direction perpendicular to the sheet conveying direction along an end (usually, a trailing end) of the sheets in contact with a reference fence which defines the position of the sheets in the conveying direction. At this time, in order to improve the accuracy in the alignment of a bundle of the stapled sheets, it is sufficient to maintain the posture of the trailing end of the sheets stacked on the staple tray. Therefore, there is known a configuration to press a bundle of sheets down while the trailing end of the bundle of the sheets is in contact with the reference fence. This configuration is implemented by a trailing end press lever illustrated in FIG. 1 to be described later; the trailing end press lever is provided at the bottom portion of a trailing end reference fence 51 so as to press the trailing end of a sheet bundle SB accommodated in the trailing end reference fence 51, and is configured to be capable of reciprocating in directions nearly perpendicular to an edge binding tray F.

However, in a configuration of a conventional edge binding unit (a configuration for maintaining the posture of the trailing end of sheets on a staple tray), sheets are aligned with the trailing end of the sheets abutting on a reference fence, and a positional relation in the conveying direction between the reference fence and a stapling unit is fixed during edge binding processing. Therefore, there has been a problem that the binding position in a sheet conveying direction in edge binding processing cannot be adjusted to a position that each user intends to set.

To cope with this problem, for example, Japanese Patent Application Laid-open No. 2008-156073 discloses the invention of a sheet processing apparatus that performs a predetermined process on a conveyed sheet member and discharges the processed sheet member; in this invention, in order to eliminate the need for a retracting mechanism of a binding device and a drive source of a trailing end fence thereby decreasing the size of the apparatus and reducing a production cost, the sheet processing apparatus includes an intermediate tray on which a conveyed sheet member is temporarily stacked; a trailing end fence that is in contact with the trailing end of a plurality of sheet members stacked on the intermediate tray and conveys the sheet members to a delivery position; an ejection claw that takes over the conveyance of the sheet members from the trailing end fence at the delivery position and conveys the sheet members from the intermediate tray; and a conveyance drive mechanism that drives the trailing end fence and the ejection claw by driving force of a single motor.

Furthermore, Japanese Patent Application Laid-open No. 2009-263127 discloses the invention of a sheet post-processing apparatus; in this invention, in order to align sheets by bringing a leading end stopper into contact with the leading end of the sheets certainly, the sheet post-processing apparatus includes a discharge roller that conveys a sheet discharged from an image forming apparatus, and stacks the sheet on an alignment tray provided at a slant; and a movable leading end stopper that presses the leading end of sheets stacked on the alignment tray and brings the trailing end of the sheets into contact with an abutting surface of a reference fence, thereby aligning the sheets in a conveying direction. The invention discloses the sheet post-processing apparatus in which a pressing amount of the leading end stopper to press sheets is variable.

However, in the invention disclosed in Japanese Patent Application Laid-open No. 2008-156073, the trailing end fence enables the delivery of a sheet member to the ejection claw, but is unable to adjust the binding depth. Furthermore, in the invention disclosed in Japanese Patent Application Laid-open No. 2009-263127, the reference fence on which the trailing end of sheets abuts when in the sheets are aligned in the sheet conveying direction is fixed, and accordingly, the binding position (binding depth) in the sheet-conveying direction in edge binding processing cannot be adjusted to a position that each user intends to set.

The present invention has been made in view of the above background, and there is a need for providing a compact and inexpensive sheet processing apparatus capable of allowing each user to arbitrarily set the binding position from an end face of a sheet bundle.

SUMMARY OF THE INVENTION

It is an object of the present invention to at least partially solve the problems in the conventional technology.

A sheet processing apparatus includes: a sheet stacking unit on which sheets are accommodated and stacked as a sheet bundle; an aligning member that is movable along a trailing end, in a conveying direction, of the sheet bundle stacked on the sheet stacking unit and that aligns the trailing end of the sheet bundle in the sheet conveying direction by abutting thereon; a binding unit that moves along the trailing end of the sheet bundle in the sheet conveying direction and binds the aligned sheet bundle; and a moving unit that moves the aligning member in the sheet conveying direction. A distance from the trailing end of the sheet bundle in the sheet conveying direction to a binding position is adjusted by moving the aligning member in the sheet conveying direction.

An image forming system includes: the sheet processing apparatus mentioned above; and an image forming apparatus that includes an image forming unit for forming an image on a sheet.

A sheet processing apparatus includes: a sheet stacking unit on which sheets are accommodated and stacked; a binding unit that is movable in a direction perpendicular to a sheet conveying direction and binds a bundle of sheets at a predetermined binding position; an aligning unit that aligns the sheets stacked on the sheet stacking unit in the sheet conveying direction; and a moving unit that adjustably moves, in the sheet conveying direction, the binding position by the binding unit with respect to an aligning position by the aligning unit.

A sheet processing method includes: discharging sheets onto a sheet stacking unit and stacking the sheets on the sheet stacking unit as a sheet bundle; moving an aligning member that aligns trailing ends of the sheets in a sheet conveying direction by abutting thereon along a trailing end, in the sheet conveying direction, of the sheet bundle stacked on the sheet stacking unit; and binding a sheet bundle, for which alignment in a sheet conveying direction and in a direction perpendicular to the sheet conveying direction has been completed, at an intended position by moving a sheet binding unit along the trailing end, in the sheet conveying direction, of the sheet bundle. A distance from the trailing end of the sheet bundle in the sheet conveying direction to a binding position is adjusted by moving the aligning member in the sheet conveying direction.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained below.

First Embodiment

In the present embodiment, a trailing end reference fence for supporting the trailing end of a sheet is configured to be movable in a conveying direction so that a binding position (binding depth) in the sheet-conveying direction on a staple tray in edge binding processing can be arbitrarily adjusted to a position that each user intends to set.

An embodiment is explained below with reference to accompanying drawings.

Figure 1:
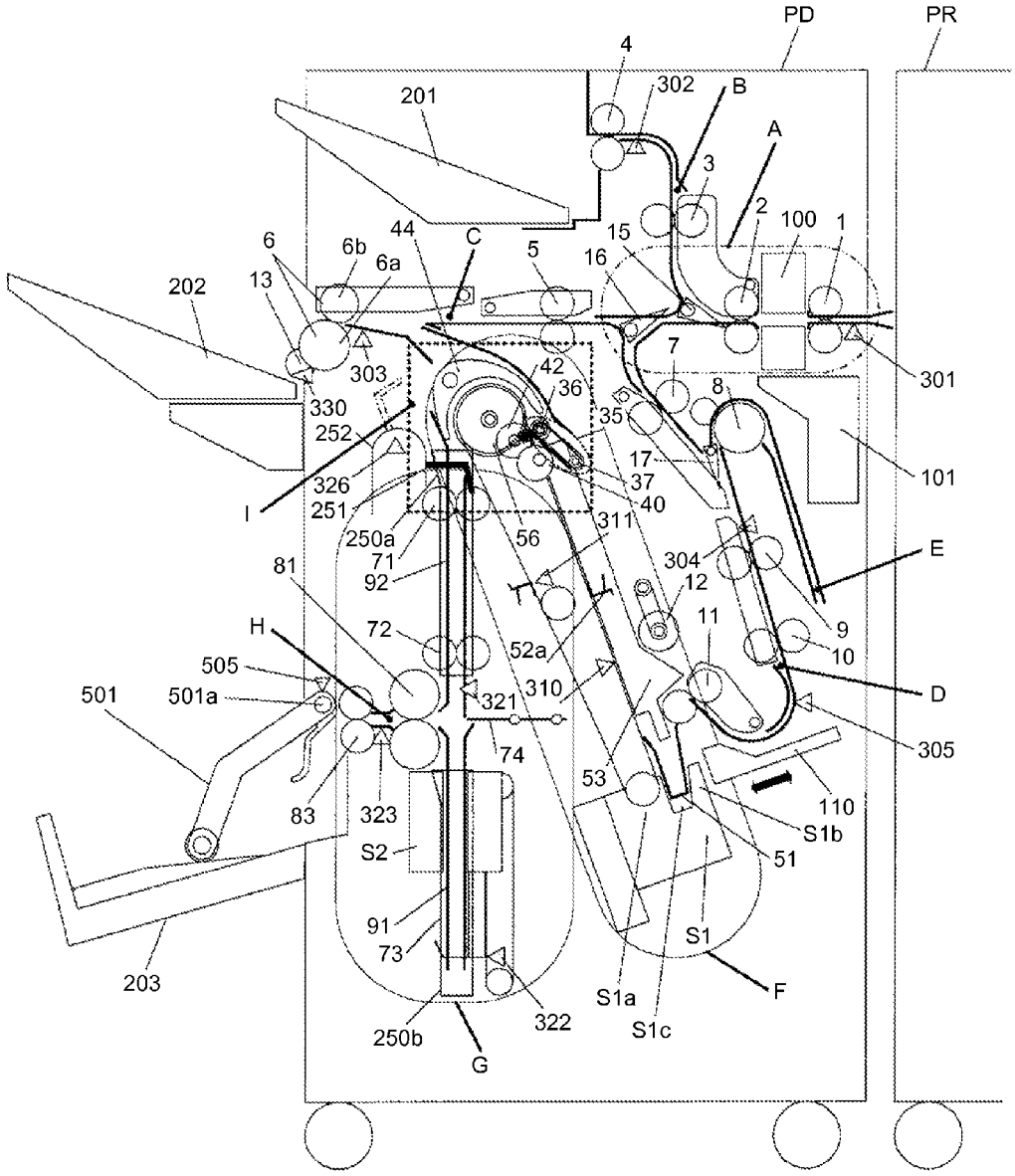
FIG. 1 is a system configuration diagram of a system including a sheet post-processing apparatus as a sheet processing apparatus according to an embodiment and an image forming apparatus.

FIG. 1 is a system configuration diagram of a system including a sheet post-processing apparatus PD as a sheet processing apparatus according to the present embodiment and an image forming apparatus PR.

In FIG. 1, the image forming apparatus PR includes at least an image processing circuit that converts input image data into printable image data; an optical writing device that performs optical writing on a photosensitive element on the basis of an image signal output from the image processing circuit; a developing device that develops a latent image formed on the photosensitive element by the optical writing device into a toner image; a transfer device that transfers the toner image developed by the developing device onto a sheet; and a fixing device that fixes the transferred toner image on the sheet, and feeds the sheet on which the toner image has been fixed to the sheet post-processing apparatus PD, and the sheet post-processing apparatus PD performs intended post-processing on the sheet. The image forming apparatus PR here is an electrophotographic type image forming apparatus as described above; however, all publicly-known image forming apparatuses, such as an ink-jet type image forming apparatus and a thermal-transfer type image forming apparatus, can be used. In this embodiment, the image processing circuit, the optical writing device, the developing device, the transfer device, and the fixing device form an image forming unit.

The sheet post-processing apparatus PD is provided on a lateral side of the image forming apparatus PR, and a sheet discharged from the image forming apparatus PR is guided into the sheet post-processing apparatus PD. The sheet post-processing apparatus PD includes a conveying path A, a conveying path B, a conveying path C, a conveying path D, and a conveying path H, and the sheet is first conveyed into the conveying path A having a post-processing unit that performs post-processing on a single sheet (in this embodiment, a punch unit 100 serving as a punching unit).

The conveying path B is a conveying path leading to an upper tray 201 through the conveying path A, and the conveying path C is a conveying path leading to a shift tray 202. The conveying path D is a conveying path leading to a processing tray F on which alignment, stapling, and the like are performed (hereinafter, also referred to as an "edge binding tray"). A sheet passing through the conveying path A is configured to be led into any of the conveying paths B, C, and D by bifurcating claws 15 and 16, respectively.

This sheet post-processing apparatus can perform various processing on a sheet, such as punching (the punch unit 100), sheet alignment and edge binding (a jogger fence 53, an edge-binding stapler S1), sheet alignment and saddle stitching (a saddle-stitching upper jogger fence 250*a*, a saddle-stitching lower jogger fence 250*b*, a saddle-stitching stapler S2), sheet sorting (the shift tray 202), and center folding (a folding plate 74, a folding roller 81). Therefore, the conveying path A and a conveying path leading from the conveying path A, i.e., any one of the conveying paths B, C, and D are selected. Furthermore, the conveying path D includes a sheet accommodating unit E, and the edge binding tray F, a saddle-stitching/center-folding tray G, and a discharge conveying path H are provided on the downstream side of the conveying path D.

On the conveying path A commonly provided to the conveying paths B, C, and D on their upstream side, an entrance sensor 301 for detecting a sheet that the sheet post-processing apparatus PD receives from the image forming apparatus PR is provided at the entrance of the conveying path A, and an entrance roller 1, the punch unit 100, a punch waste hopper 104, a conveying roller 2, and the first and second bifurcating claws 15 and 16 are provided on the downstream of the entrance sensor 301 in this order. The first bifurcating claw 15 and the second bifurcating claw 16 are held in a state illustrated in FIG. 1 (an initial state) by springs (not shown); when first and second solenoids (not shown) are turned ON, the first bifurcating claw 15 and the second bifurcating claw 16 are driven, respectively. A sheet is led into any one of the conveying paths B, C, and D by selecting ON/OFF of the first and second solenoids thereby changing a combination of the bifurcating directions of the first and second bifurcating claws 15 and 16.

When a sheet is led into the conveying path B, the first and second bifurcating claws 15 and 16 are kept in the state illustrated in FIG. 1, i.e., the first solenoid is OFF (the first bifurcating claw 15 points downward in the initial state). The sheet is discharged onto the upper tray 201 through a conveying roller 3 and a discharge roller 4.

When a sheet is led into the conveying path C, the first and second solenoids are both turned ON, so that the bifurcating claw 15 is turned upward from the state illustrated in FIG. 1 and the bifurcating claw 16 is turned downward from the state illustrated in FIG. 1 (the second bifurcating claw 16 points upward in the initial state). Thus, the sheet is conveyed to the side of the shift tray 202 through a conveying roller 5 and a pair of discharge rollers 6 (6*a* and 6*b*). In this case, sorting of the sheet is performed. The sheet sorting is performed by a shift-tray discharge unit provided on the most downstream of the sheet post-processing apparatus PD. The sheet sorting is performed by using the pair of shift discharge rollers 6 (6*a* and 6*b*), a return roller 13, a sheet-surface detection sensor 330, the shift tray 202, a shift mechanism (not shown) that reciprocates the shift tray 202 in the directions perpendicular to the sheet conveying direction, and a shift-tray lifting mechanism for lifting up and down the shift tray 202.

When a sheet is led into the conveying path D, the first solenoid for driving the first bifurcating claw 15 is turned ON and the second solenoid for driving the second bifurcating claw 16 is turned OFF, so that the bifurcating claw 15 is turned upward and the bifurcating claw 16 is turned downward, and the sheet is led to the side of the conveying path D by passing through the conveying roller 2 and a conveying roller 7. The sheet having been led into the conveying path D is led into the edge binding tray F, and sheets having been aligned and stapled on the edge binding tray F are guided, by a guide member 44, to one of the conveying path C leading into the shift tray 202 and the saddle-stitching/folding tray G on which folding and the like are performed on a bundle of sheets (hereinafter, also simply referred to as a "saddle stitching tray"). When the sheet bundle is led into the shift tray 202, the sheet bundle is discharged onto the shift tray 202 by the pair of discharge rollers 6. When the sheet bundle is led into the saddle stitching tray G, the sheet bundle is folded and bound on the saddle stitching tray G, and passes through the discharge conveying path H and is discharged onto a lower tray 203 by a discharge roller 83.

On the conveying path D, a bifurcating claw 17 is provided; the bifurcating claw 17 is held in a state illustrated in FIG. 1 by a low-load spring (not shown). After the trailing end of the sheet conveyed by the conveying roller 7 has passed through the bifurcating claw 17, the sheet can be conveyed in a reverse direction along a turn guide 8 by reverse rotation of at least a conveying roller 9 among conveying rollers 9 and 10 and a staple discharge roller 11. This leads the sheet into the sheet accommodating unit E from the trailing end of the sheet, and the sheet is accumulated (pre-stacked) on the sheet accommodating unit E so that a subsequent sheet can be stacked on the sheet to convey a stack of the sheets. By repeating this operation, a stack of two or more sheets can be conveyed. Incidentally, a reference numeral 304 denotes a pre-stack sensor for setting the timing to feed a sheet in the reverse direction when the sheet is to be pre-stacked.

When sheet alignment and edge binding are performed on a bundle of sheets having been led into the conveying path D, a sheet led into the edge binding tray F by the staple discharge roller 11 is sequentially stacked on the edge binding tray F. In this case, each sheet is aligned in a longitudinal direction (a sheet conveying direction) by a tapping roller 12 one by one, and further aligned in a lateral direction (a direction perpendicular to the sheet conveying direction, also referred to as a "sheet width direction") by the jogger fence 53. In an interval between successive jobs, i.e., an interval between the last sheet of a sheet bundle and the first sheet of a subsequent sheet bundle, the edge-binding stapler S1 serving as a binding unit is driven in response to a staple signal from a control device (not shown), and the edge-binding stapler S1 staples the sheet bundle. The stapled sheet bundle is immediately conveyed to a shift discharge roller 6 by an ejection belt 52 (see FIG. 2) on which an ejection claw 52*a* is provided in a protruding manner, and is discharged onto the shift tray 202 set in a receiving position.

Incidentally, as shown in FIG. 1, the edge-binding stapler S1 includes a stitcher (a driver) S1*a* that drives a staple and a clincher S1*b* that bends the tips of the staple, and trailing end reference fences 51*a* and 51*b* can go through a gap S1*c* formed between the stitcher S1*a* and the clincher S1*b*, and therefore, the edge-binding stapler S1 moves without interfering with the trailing end reference fences 51*a* and 51*b*. Furthermore, unlike the saddle-stitching stapler S2, the edge-binding stapler S1 is integrally formed by the stitcher S1*a* and the clincher S1*b*. The stitcher S1*a* does not move in a direction perpendicular to the sheet surface and functions as the stationary side; the clincher S1*b* functions as the movable side that moves in the direction perpendicular to the sheet surface. Therefore, when a sheet bundle SB is to be bound, stapling is performed in a process during which the clincher S1*b* moves a predetermined binding portion of the sheet bundle SB abutting on stack surfaces 51*a*1 and 51*b*1 of the trailing end reference fences 51 toward the stitcher S1*a*.

Figure 2:
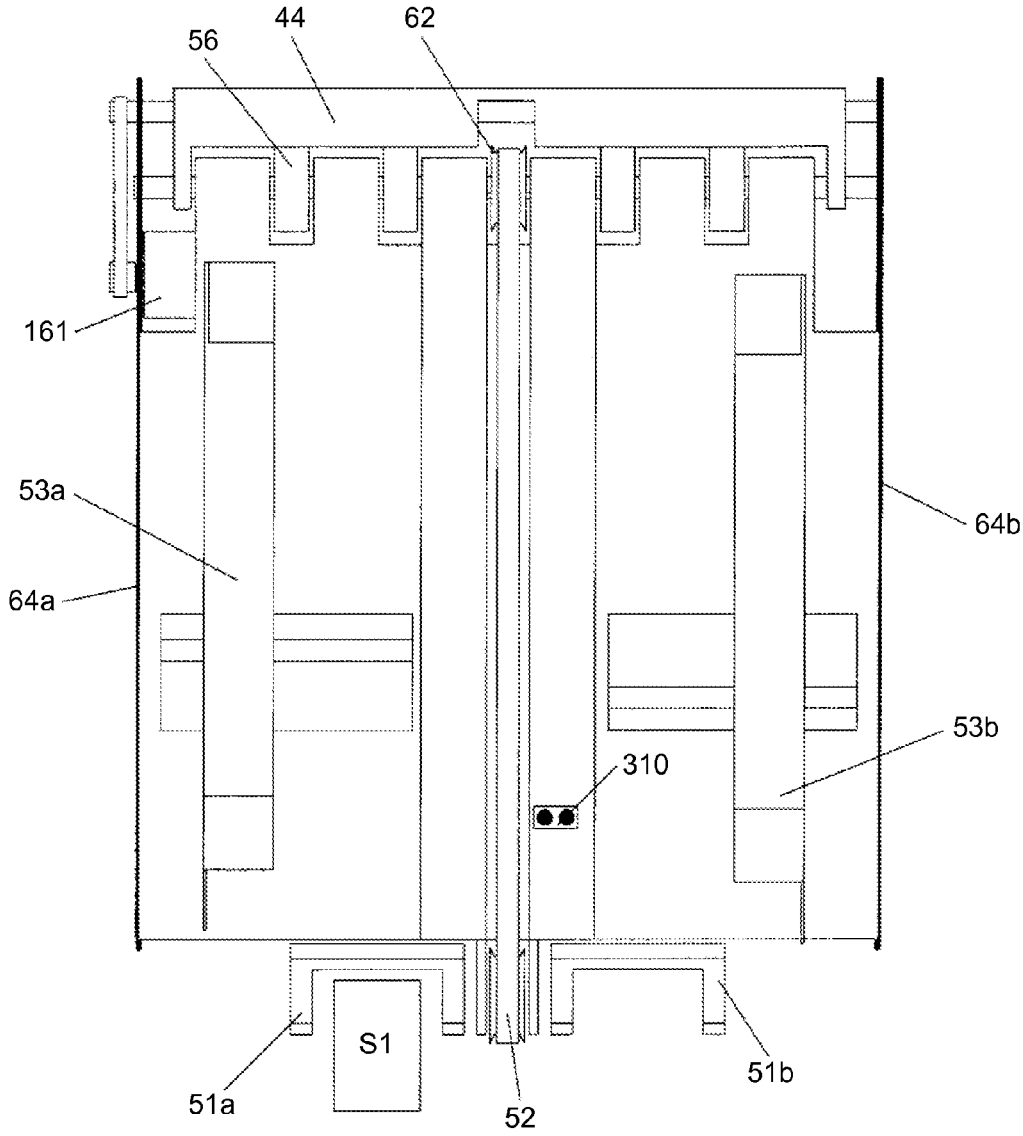
FIG. 2 is a schematic configuration diagram of an edge binding tray in FIG. 1 viewed from a side of a stack surface of the tray.
Figure 4:
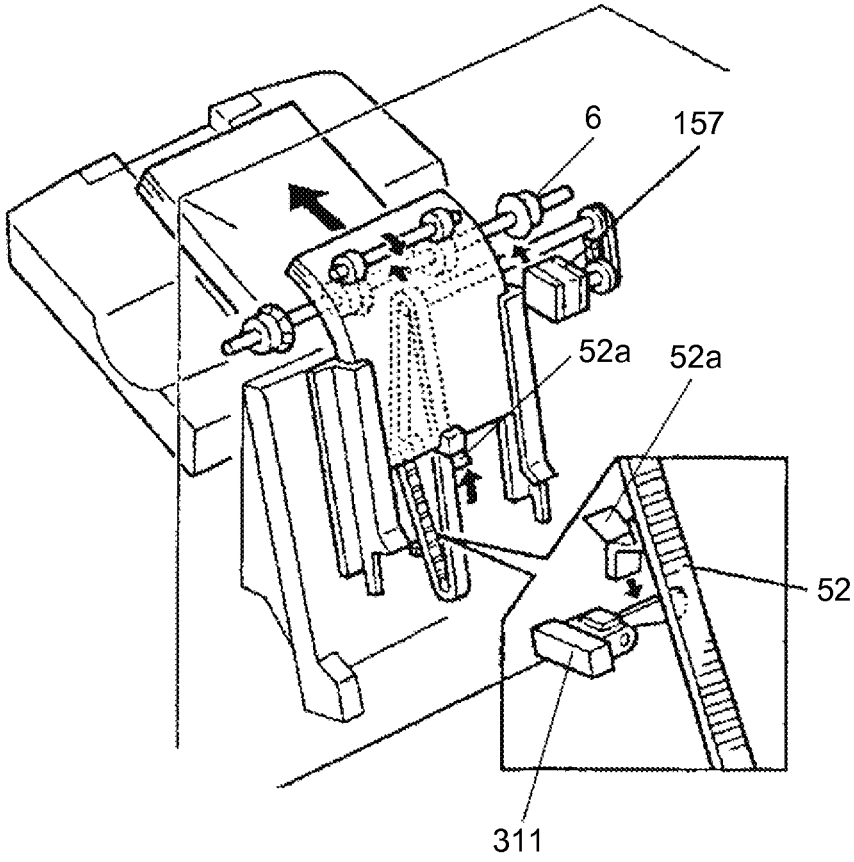
FIG. 4 is a side view illustrating the operation of an ejection belt in FIG. 1.

As illustrated in FIGS. 2 and 4, the ejection belt 52 is provided in the alignment center in the sheet width direction; the ejection belt 52 is suspended between pulleys 62, and driven by an ejection-belt drive motor 157. A plurality of ejection rollers 56 is provided to be symmetrical about the ejection belt 52; the ejection rollers 56 are rotatably attached to a drive shaft, and function as driven rollers.

A home position (HP) of the ejection claw 52*a* is detected by an ejection-belt HP sensor 311; the ejection-belt HP sensor 311 is turned ON/OFF by the ejection claw 52*a* provided on the ejection belt 52. Two ejection claws 52*a* are provided on an outer circumferential surface of the ejection belt 52 so as to be opposed to each other, and alternately move and convey a sheet bundle accommodated in the edge binding tray F. Furthermore, by rotating the ejection belt 52 in a reverse direction as necessary, the leading end, in the sheet conveying direction, of a sheet bundle accommodated in the edge binding tray F can be aligned with the back side of the ejection claw 52*a* waiting to move the sheet bundle and the back side of the other ejection claw 52*a* arranged on the opposite side.

Incidentally, in FIG. 1, a reference numeral 110 denotes a trailing end press lever; the trailing end press lever 110 is provided at the bottom portion of the trailing end reference fence 51 so as to press the trailing end of a sheet bundle SB accommodated in the trailing end reference fence 51, and reciprocates in directions nearly perpendicular to the edge binding tray F. A sheet discharged onto the edge binding tray F is aligned in the longitudinal direction (the sheet conveying direction) by the tapping roller 12 one by one; however, if the trailing end of the sheet stacked on the edge binding tray F is curled or the sheet is inelastic, the trailing end of the sheet is prone to buckle and bulge under a weight of the sheet itself. Furthermore, as the number of stacked sheets increases, a space left in the trailing end reference fence 51 where a subsequent sheet enters becomes smaller, and the accuracy of alignment in the longitudinal direction is prone to be degraded. Therefore, a trailing end pressing mechanism is provided to suppress a bulge of the trailing end of a sheet thereby making it easier for the sheet to enter the trailing end reference fence 51, where the trailing end press lever 110 directly presses the sheet.

Furthermore, in FIG. 1, reference numerals 302, 303, 304, 305, and 310 denote detection sensors to detect whether a sheet has passed through or whether a sheet is stacked at each of the positions where the corresponding detection sensor is provided.

FIG. 2 is a schematic configuration diagram of the edge binding tray F viewed from the side of the stack surface of the tray, which corresponds to a view from the right side in FIG. 1. In FIG. 2, alignment, in the width-direction, of a sheet that the sheet post-processing apparatus PD has received from the image forming apparatus PR being provided on the upstream side is performed by using jogger fences 53*a* and 53*b*, and alignment of the sheet in the longitudinal-direction is performed by causing the sheet to abut on the first and second trailing end reference fences 51*a* and 51*b* (denoted by the reference numeral 51 in FIG. 1). FIG. 6 illustrates a relation among a sheet bundle SB stacked on the edge binding tray F, the trailing end reference fences 51*a* and 51*b*, and the edge-binding stapler S1 when edge binding is to be performed. As can be seen from FIG. 6, the first and second trailing end reference fences 51*a* and 51*b* have stack surfaces 51*a*1 and 51*b*1 on which the sheet trailing end ST abuts and is held on the inner side thereof, respectively, and support the sheet trailing end ST. The stack surfaces 51*a*1 and 51*b*1 are supported by supporting members 51*a*2 and 51*b*2, respectively.

Figure 6A:
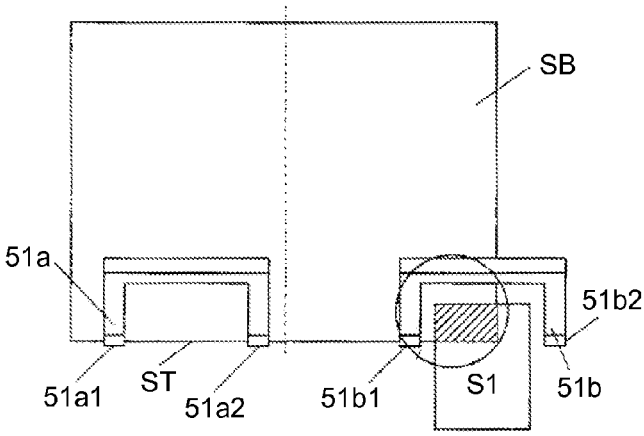
FIG. 6 is a diagram illustrating a relation among, a sheet stacked on the edge binding tray, a trailing end reference fence, and an edge-binding stapler when edge binding is performed.
Figure 6B:
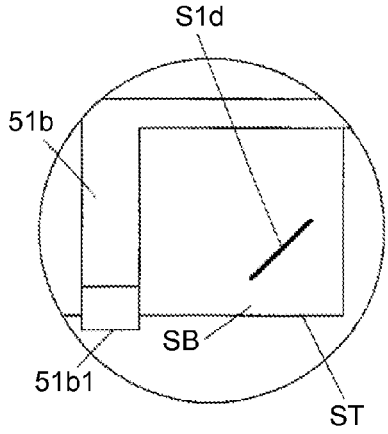

As can be seen from FIG. 2, the sheet trailing end ST can be supported at four points; however, when one-point diagonal stapling is to be performed, the edge-binding stapler S1 moves to an end of a stacked sheet bundle SB, and staples the sheet bundle SB in a state where the edge-binding stapler S1 is tilted at an angle. FIG. 6B shows a relation between a staple Sid and the trailing end fence 51*b* after the sheet bundle SB is stapled. At this time, as illustrated in FIG. 6A, the sheet bundle SB is stacked with the trailing end ST by being in contact with any two of the stack surfaces 51*a*1, 51*a*2, and 51*b*1 of the trailing end fences 51. This is due to a mechanical error including the installation accuracy of the trailing end fences 51*a* and 51*b*, and the sheet bundle SB is supported by two points, thereby being supported in a stable state.

After completion of the alignment, the sheet bundle SB is stapled by the edge-binding stapler S1, and, as can be seen from a perspective view of FIG. 4 illustrating the operation of the ejection belt, the ejection belt 52 is driven to rotate in a counterclockwise direction by the ejection-belt drive motor 157, and the stapled sheet bundle is scooped up by the ejection claw 52*a* provided on the ejection belt 52 and ejected from the edge binding tray F. Incidentally, reference numerals 64*a* and 64*b* denote a front-side plate and a back-side plate, respectively. Furthermore, this operation can be also performed on a non-bound sheet bundle that is not stapled after the alignment.

Figure 3:
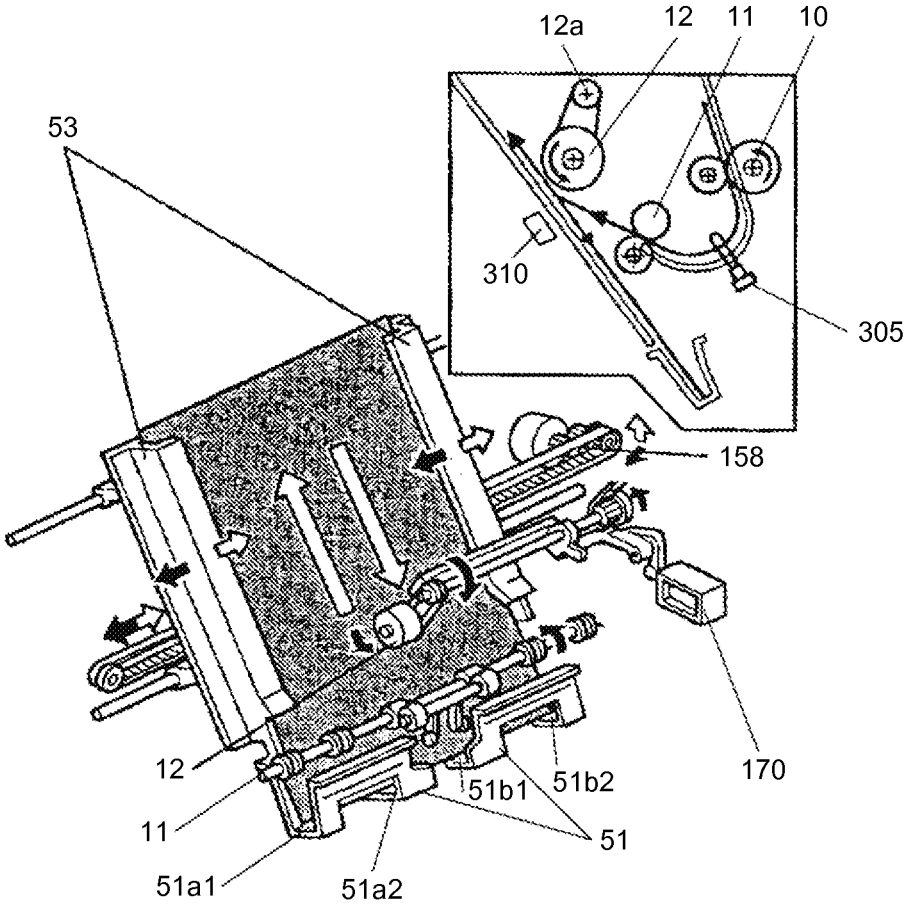
FIG. 3 is a perspective view illustrating a schematic configuration of the edge binding tray in FIG. 1 and a mechanism attached to the edge binding tray.

FIG. 3 is a perspective view illustrating a schematic configuration of the edge binding tray F and a mechanism attached to the edge binding tray F. As illustrated in FIG. 3, a sheet guided into the edge binding tray F by the staple discharge roller 11 is sequentially stacked on the edge binding tray F. At this time, if the number of sheets discharged onto the edge binding tray F is one, the sheet is aligned in the longitudinal direction (the sheet conveying direction) by the tapping roller 12 one by one, and further aligned in the width direction (the sheet width direction perpendicular to the sheet conveying direction) by the jogger fences 53*a* and 53*b*. The tapping roller 12 is driven to swing about a fulcrum 12*a* like a pendulum by a tapping SOL 170, and intermittently acts on a sheet led into the edge binding tray F to abut on the trailing end ST of the sheet on the trailing end reference fences 51. Incidentally, the tapping roller 12 rotates in a counterclockwise direction. As illustrated in FIGS. 2 and 3, a pair of the front and back jogger fences 53 (53*a* and 53*b*) is provided; the jogger fences 53 are driven, via a timing belt, to reciprocate in the sheet width direction by a jogger motor 158 capable of rotating in forward and reverse directions.

Figure 5:
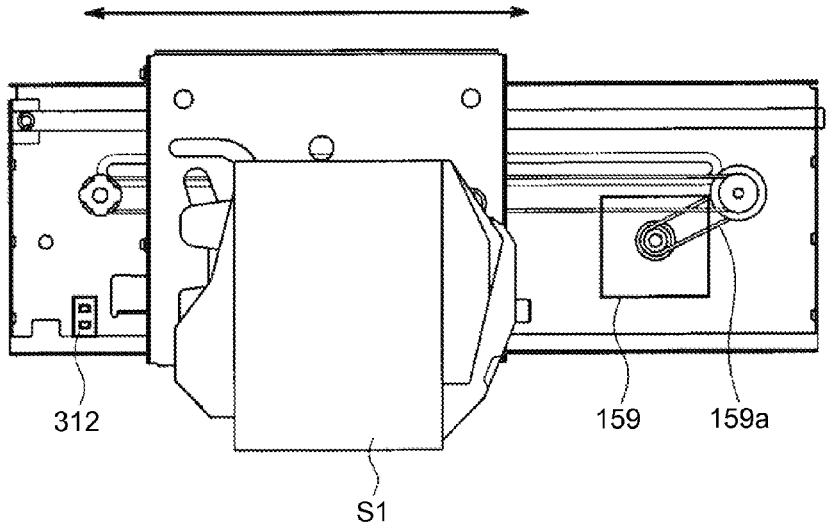
FIG. 5 is a perspective view illustrating the moving mechanism of a stapler in FIG. 1.

FIG. 5 is a side view illustrating a stapler moving mechanism. As illustrated in FIG. 5, the edge-binding stapler S1 is driven by a stapler moving motor 159 capable of rotating in the forward and reverse directions via a timing belt 159*a* and moves in the sheet width direction so as to bind a trailing end portion of a sheet bundle at a predetermined position. At one end of a moving range of the edge-binding stapler S1, a stapler moving HP sensor 312 for detecting a home position of the edge-binding stapler S1 is provided, and the binding position in the sheet width direction is controlled by a moving amount of the edge-binding stapler S1 from the home position. The edge-binding stapler S1 is configured to staple the trailing end of a sheet bundle at one point or a plurality of points (generally, two points), and is movable at least across the full width of the trailing end ST of a sheet bundle supported by the trailing end reference fences 51*a* and 51*b*. Furthermore, for replenishment of staples, the edge-binding stapler S1 is configured to be moved to the front side of the apparatus maximally so as to make it easy for a user to perform the staple replenishing operation.

On the downstream side of the edge binding tray F in the sheet conveying direction, a sheet-bundle deflecting mechanism I is provided. As illustrated in FIG. 1, a conveying path for conveying a sheet bundle SB from the edge binding tray F to the saddle stitching tray G or another conveying path for conveying the sheet bundle SB from the edge binding tray F to the shift tray 202 and a conveying unit for conveying the sheet, bundle SB are configured by a conveying mechanism 35 that applies conveying force to the sheet bundle SB, the ejection rollers 56 that turns the sheet bundle SB, and the guide member 44 that guides the sheet bundle SB to turn the sheet bundle SB.

To explain the detailed configurations, driving force of a drive shaft 37 is configured to be transmitted to a roller 36 of the conveying mechanism 35 by a timing belt, and the roller, 36 and the drive shaft 37 are connected and supported by an arm, so that the roller 36 can swing with the drive shaft 37 as a fulcrum of rotation. The roller 36 is driven to oscillate by the conveying mechanism 35 via a cam 40; the cam 40 rotates about a rotating shaft, and is driven to rotate by a motor (not shown). In the conveying mechanism 35, a driven roller 42 is provided to be opposed to the roller 36; a sheet bundle is interposed between the driven roller 42 and the roller 36, applied pressure exerted through an elastic material, and applied conveying force.

A conveying path for turning a sheet bundle from the edge binding tray F to the saddle stitching tray G is formed between the ejection rollers 56 and the inner surface of the guide member 44 on the side opposed to the ejection rollers 56. The guide member 44 is driven to turn about a fulcrum by a bundle bifurcation drive motor 169 (see FIG. 2). When a sheet bundle is conveyed from the edge binding tray F to the shift tray 202, the guide member 44 turns about the fulcrum in a clockwise direction, and a gap between the outer surface (the surface on the side not opposed to the ejection rollers 56) of the guide member 44 and an outer guide plate functions as a conveying path. When a sheet bundle P is conveyed from the edge binding tray F to the saddle stitching tray G, the trailing end of a sheet bundle SB aligned in the edge binding tray F is lifted up by the ejection claw 52*a*, and interposed between the roller 36 of the conveying mechanism 35 and the driven roller 42 opposed to the roller 36, thereby conveying force is applied to the sheet bundle SB. At this time, the roller 36 of the conveying mechanism 35 is retracted at a position where the roller 36 does not hit the leading end of the sheet bundle SB. Then, after the leading end of the sheet bundle SB has passed therethrough, the roller 36 of the conveying mechanism 35 is brought into contact with the sheet surface to apply conveying force to the sheet bundle SB. At this time, a guide of a turn conveying path is formed by the guide member 44 and the ejection rollers 56, and the sheet bundle SB is conveyed into the saddle stitching tray G on the downstream.

As shown in FIG. 1, the saddle stitching tray G is provided on the downstream side of the sheet-bundle deflecting mechanism including the guide member 44 and the ejection rollers 56. The saddle stitching tray G is provided almost vertically on the downstream side of the sheet-bundle deflecting mechanism, and a folding mechanism is provided at the center of the saddle stitching tray G, and an upper bundle conveyance guide plate 92 and a lower bundle conveyance guide plate 91 are provided above and below the folding mechanism, respectively.

Furthermore, an upper bundle conveying roller 71 and a lower bundle conveying roller 72 are provided above and below the upper bundle conveyance guide plate 92, respectively, and the saddle-stitching upper jogger fence 250*a* is provided along both of the side surfaces of the upper bundle conveyance guide plate 92 so as to bridge between the rollers 71 and 72. Similarly, the saddle-stitching lower jogger fence 250*b* is provided along both of the side surfaces of the lower bundle conveyance guide plate 91, and the saddle-stitching stapler S2 is provided in a place where the saddle-stitching lower jogger fence 250*b* is provided. The saddle-stitching upper jogger fence 250*a* and the saddle-stitching lower jogger fence 250*b* are driven by a drive mechanism (not shown), and align a sheet bundle in the direction perpendicular to the sheet conveying direction (the sheet width direction). Two saddle-stitching staplers S2, each including a pair of a clincher unit and a driver unit, are provided in the sheet width direction by keeping a predetermined distance between the two saddle-stitching staplers S2.

Furthermore, a movable trailing end reference fence 73 is provided across the lower bundle conveyance guide plate 91, and is able to be moved in the sheet conveying direction (in up-and-down directions in FIG. 1) by a moving mechanism including a timing belt and a drive mechanism for driving the timing belt. As illustrated in FIG. 1, the drive mechanism includes a drive pulley and a driven pulley between which the timing belt is suspended, and a stepping motor for driving the drive pulley. Similarly, on the top side of the upper bundle conveyance guide plate 92, a trailing end tapping claw 251 and a drive mechanism for driving the trailing end tapping claw 251 are provided. The trailing end tapping claw 251 is movable in a reciprocating manner in a direction away from the sheet-bundle deflecting mechanism and a direction to press the trailing end of a sheet bundle (the side corresponding to the trailing end of a sheet bundle when the sheet bundle is led) by a timing belt 252 and a drive mechanism (not shown).

The folding mechanism is provided nearly at the center of the saddle stitching tray G, and includes the folding plate 74, the folding roller 81, and the conveying path H for conveying a folded sheet bundle. In FIG. 1, a reference numeral 326 denotes an HP sensor for detecting a home position of the trailing end tapping claw 251; a reference numeral 323 denotes a folding-unit passage sensor for detecting a center-folded sheet bundle; a reference numeral 321 denotes a bundle detection sensor for detecting the arrival of a sheet bundle at a center-folding position; a reference numeral 322 denotes a movable trailing end reference fence HP sensor for detecting a home position of the movable trailing end reference fence 73.

Furthermore, in this embodiment, a detection lever 501 for detecting the height of a stack of a center-folded sheet bundle SB is provided on the lower tray 203 so that the detection lever 501 can swing about a fulcrum 501*a*, and a sheet-surface sensor 505 detects an angle of the detection lever 501, thereby detecting the up-and-down movement of the lower tray 203 and whether the stack of the center-folded sheet bundles SB overflows on the lower tray 203.

Figure 7:
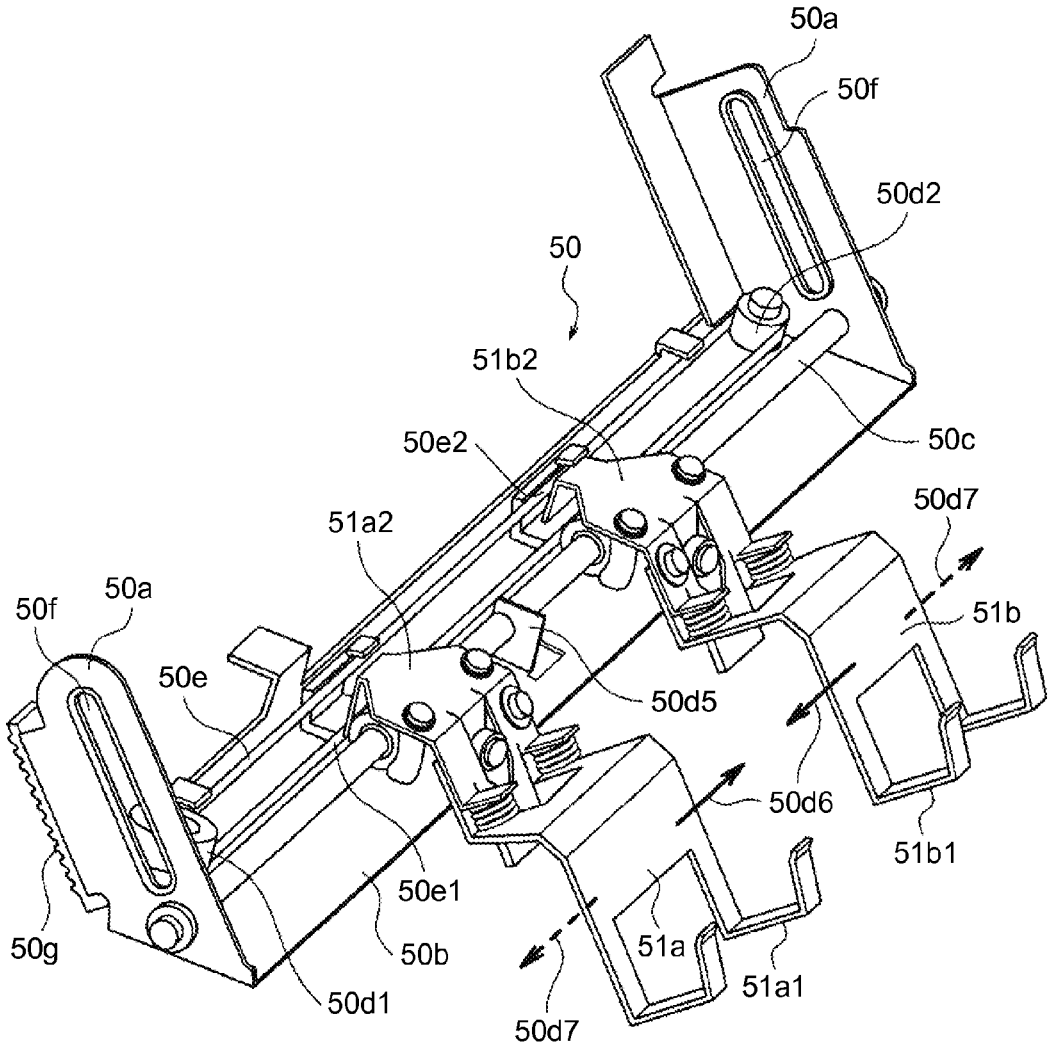
FIG. 7 is a perspective view illustrating a mechanism for moving the trailing end reference fence in a direction perpendicular to a sheet conveying direction.
Figure 8:
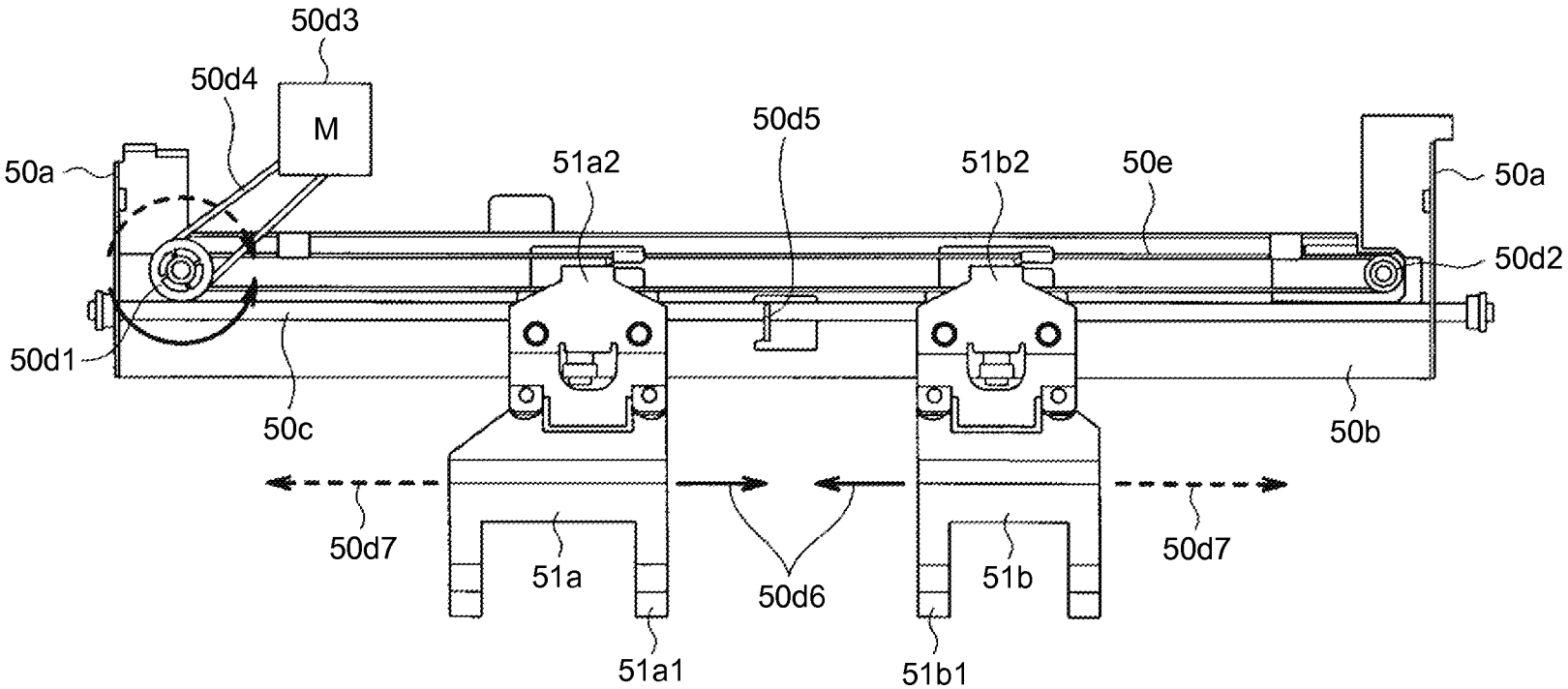
FIG. 8 is a side view of the mechanism illustrated in FIG. 7.

FIG. 7 is a perspective view illustrating a mechanism 50 for moving the trailing end reference fence in the direction perpendicular to the sheet conveying direction (hereinafter, referred to as "width-direction moving mechanism 50"). FIG. 8 is a side view of the width-direction moving mechanism 50.

In FIGS. 7 and 8, the width-direction moving mechanism 50 of the trailing end reference fence includes a base 50*b*, a slide shaft 50*c*, a timing belt 50*e*, and a width-direction fence drive motor 50*d*3. Side plates 50*a* are provided vertically on both sides of the base 50*b*. The slide shaft 50*c* is fixed to the side plates 50*a* so as to be supported between the side plates 50*a*, and slidably supports the supporting members 51*a*2 and 51*b*2 of the trailing end reference fences 51*a* and 51*b*. The timing belt 50*e* is suspended between a drive timing pulley 50*d*1 and a driven timing pulley 50*d*2 to be parallel to the slide shaft 50*c*, and driven to rotate when the drive timing pulley 50*d*1 is driven by the width-direction fence drive motor 50*d*3 via a drive pulley 50*d*4.

In the width-direction moving mechanism 50, the supporting member 51*a*2 of the trailing end reference fence 51*a* is attached to one (50*e*1) of the parallel sides of the timing belt 50*e* and the supporting member 51*b*2 of the trailing end reference fence 51*b* is attached to the other side 50*e*2 of the timing belt 50*e* so that the supporting members 51*a*2 and 51*b*2 are symmetrical about a supporting member 50*d*5 provided at the center in the width-direction. Therefore, for example, when the timing belt 50*e* rotates to the right, the supporting members 51*a*2 and 51*b*2 symmetrically come close to the supporting member 50*d*5 (in directions indicated by arrows 50*d*6); when the timing belt 50*e* rotates to the left, the supporting members 51*a*2 and 51*b*2 symmetrically move away from the supporting member 50*d*5 (in the directions indicated by arrows 50*d*7). Consequently, the positions of the stack surfaces 51*a*1 and 51*b*1 and a distance between the stack surfaces 51*a*1 and 51*b*1 can be set by a rotating amount of the fence drive motor 50*d*3. Therefore, in view of the controllability and the control accuracy, for example, a stepping motor is used as the width-direction fence drive motor 50*d*3.

Figure 9:
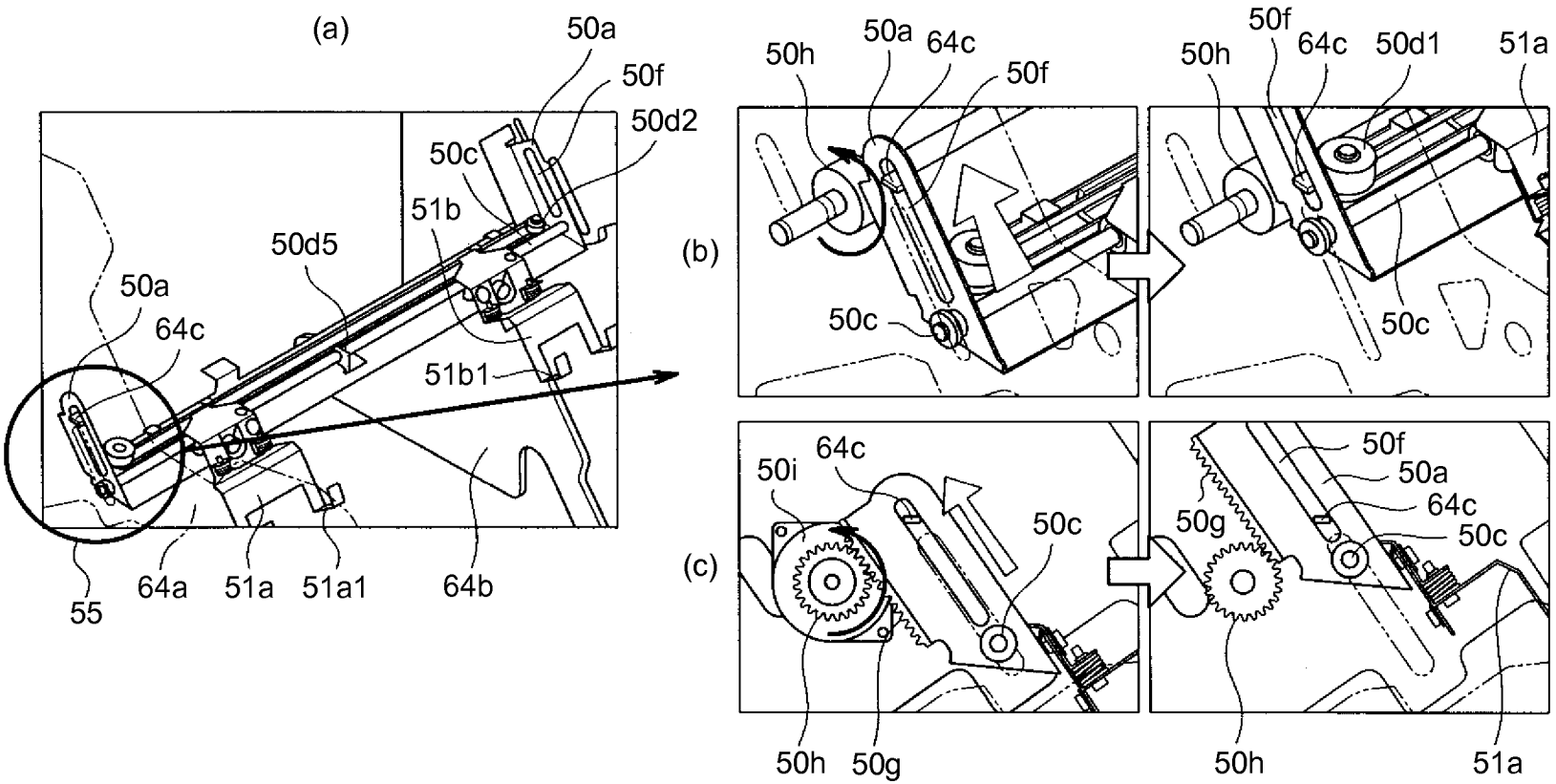
FIG. 9 is an explanatory diagram illustrating an example of a moving mechanism for moving the trailing end reference fence in the sheet conveying direction according to a first embodiment and the operation of the moving mechanism.
Figure 10:
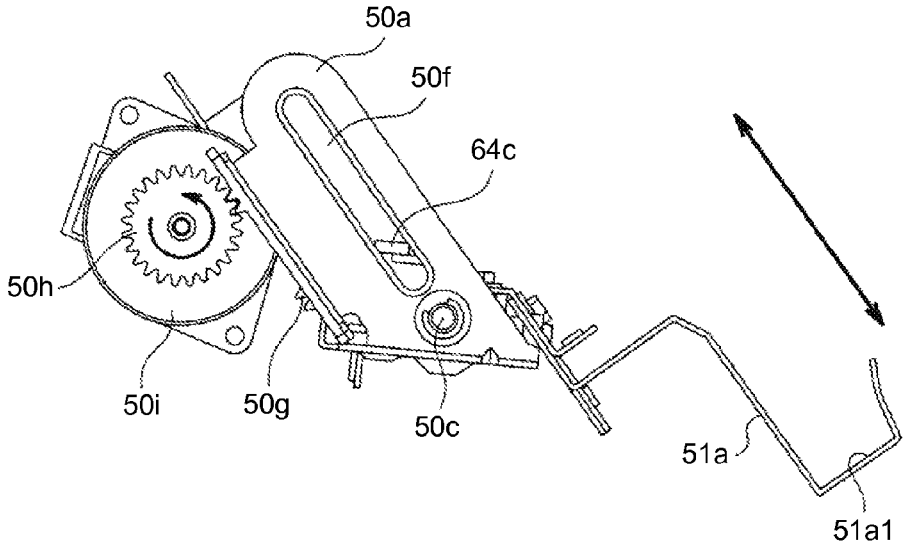
FIG. 10 is a partial front view illustrating only a mechanical portion of the moving mechanism.
Figure 11:
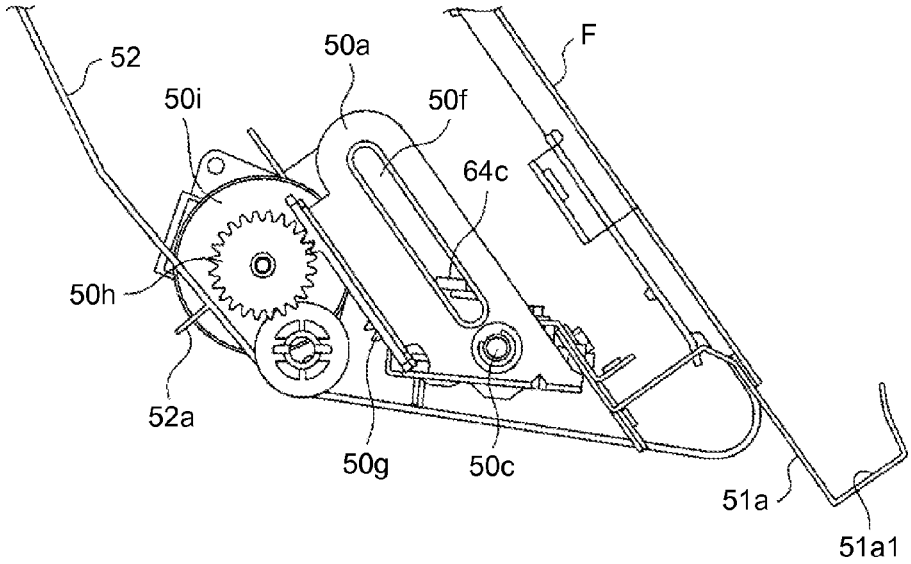
FIG. 11 is a partial front view illustrating the mechanical portion in FIG. 10 to which the edge binding tray and the ejection belt are attached.
Figure 12:
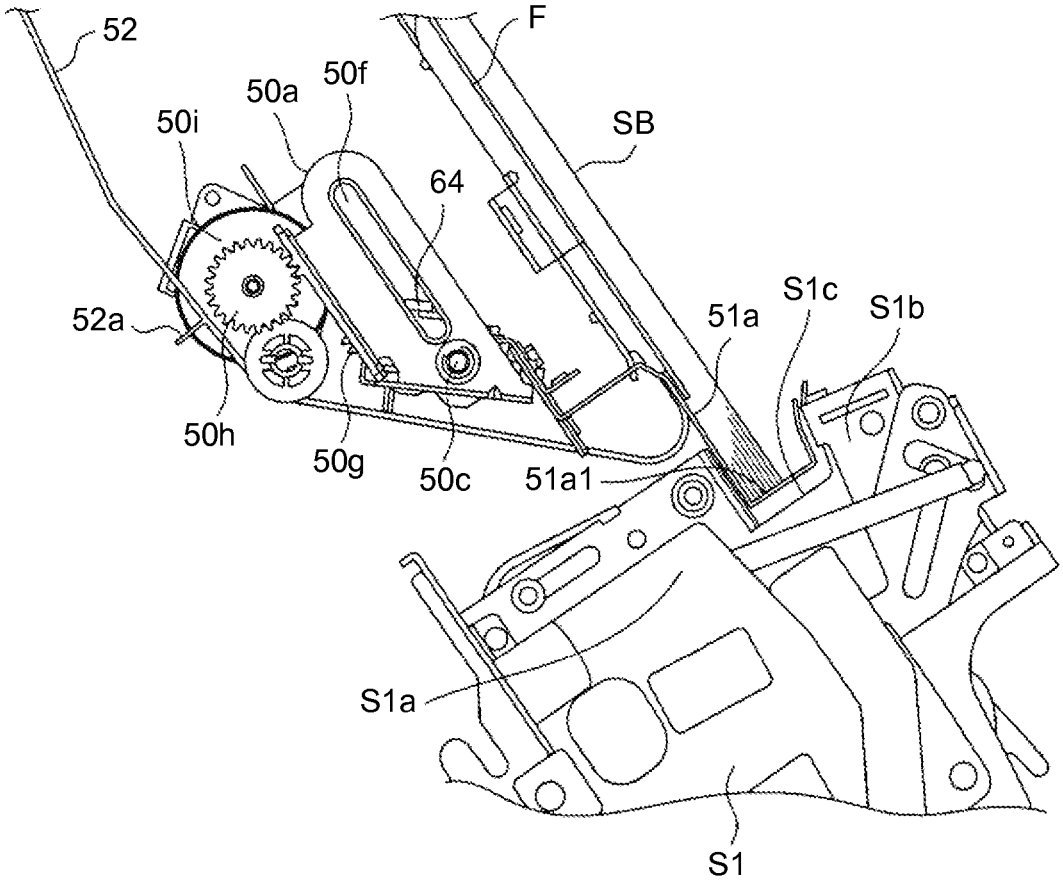
FIG. 12 is a partial front view illustrating a relation between the mechanical portion in FIG. 11 and the edge-binding stapler, and illustrates a state where a sheet bundle is stacked on the trailing end reference fence.

FIG. 9 is an explanatory diagram illustrating an example of a mechanism 55 for moving the trailing end reference fences 51 in the sheet conveying direction (hereinafter, referred to as the "conveying direction moving mechanism 55") according to the first embodiment and the operation of the conveying direction moving mechanism 55. FIG. 10 is a partial front view illustrating only a mechanical portion of the moving mechanism. FIG. 11 is a partial front view illustrating the mechanical portion in FIG. 10 to which the edge binding tray and the ejection belt are attached. FIG. 12 a partial front view illustrating a relation between the mechanical portion in FIG. 11 and the edge-binding stapler, and illustrates a state where a sheet bundle is stacked on the trailing end reference fences.

In FIGS. 9 to 12, the conveying direction moving mechanism 55 of the trailing end reference fences 51 includes a slide groove 50*f*, a projecting member 64*c*, a rack 50*g*, a pinion 50*h*, and a conveying direction fence drive motor 50*i*. The slide groove 50*f* is formed on each of a pair of the side plates 50*a* vertically provided on the base 50*b* so as to be parallel to the bottom plate of the edge binding tray F. The projecting members 64*c* are vertically provided from the front-side plate 64*a* and the back-side plate 64*b* and are freely fitted in the slide grooves 50*f*, respectively, and restrict the moving position of the side plate 50*a* and allow the side plate 50*a* to move only in a direction parallel to the bottom plate of the edge binding tray F. This movement is accomplished by the pinion 50*h* to which driving force is transmitted from a rotating shaft of the conveying direction fence drive motor 50*i* and the rack 50*g* provided on the end face of one of the side plates 50*a* that engages with the pinion 50*h*. In the present embodiment, the position of the side plate 50*a* can be set to an arbitrary position in a range from an initial position illustrated in FIG. 9B (the lowermost position) to a maximum drive position illustrated in FIG. 9C (the uppermost position) according to a rotating amount of the conveying direction fence drive motor 50*i*. Incidentally, in the present embodiment, in view of the controllability and the positional accuracy, a stepping motor is used for the conveying direction fence drive motor 50*i*.

When the binding position in the conveying direction and the binding position in the width direction are set, the edge-binding stapler S1 is moved to the binding position as illustrated in FIG. 12, and staples a sheet bundle SB by causing the stitcher S1*a* to drive a staple Sid through the sheet bundle SB and causing the clincher S1*b* to bend the tips of the staple Sid. Then, upon completion of the stapling, the edge-binding stapler S1 returns to the home position and waits for the next action, and the sheet bundle SB is discharged from the edge-binding stapler F by the ejection claw 52*a* in accordance with the rotation of the ejection belt 52.

In this manner, the positions of the trailing end reference fences 51*a* and 51*b* in the sheet width direction are set by the fence drive motor 50*d*3, and the positions of the trailing end reference fences 51*a* and 51*b* in the sheet conveying direction are set by the conveying direction fence drive motor 50*i*. Incidentally, the position of a sheet S in the width direction is changed according to the sheet size and the stapling position in the width direction, and the position of the sheet S in the conveying direction is changed according to a set amount of the binding position from the sheet trailing end ST. Incidentally, the conveying direction moving mechanism 55 is not a part that is frequently required to run; therefore, preferably, the conveying direction moving mechanism 55 is configured to include, for example, a worm gear incapable of driving backward or a mechanical holding mechanism, thereby to minimize power necessary for driving the conveying direction moving mechanism 55.

Figure 13:
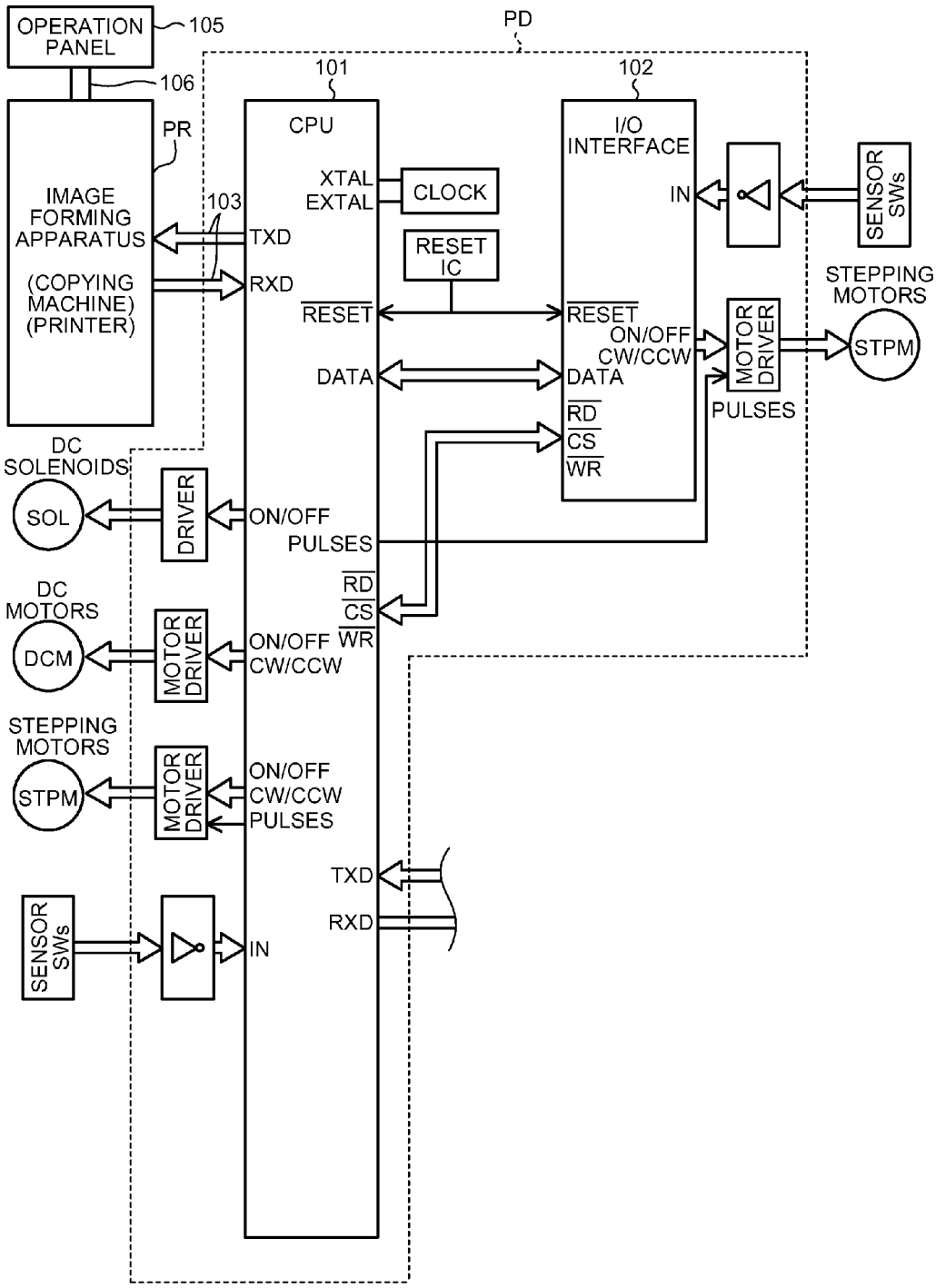
FIG. 13 is a block diagram illustrating a control configuration of an image forming system including the sheet post-processing apparatus and the image forming apparatus.

FIG. 13 is a block diagram illustrating a control configuration of the image forming system including the sheet post-processing apparatus PD and the image forming apparatus PR. The sheet post-processing apparatus PD includes a control circuit equipped with a microcomputer having a central processing unit (CPU) 101, an I/O interface 102, and the like. A signal from a CPU, a switch of an operation panel 105, a sensor (not shown), or the like, of the image forming apparatus PR is input to the CPU 101 via a communication interface 103, and the CPU 101 executes predetermined control on the basis of the input signal. Furthermore, the CPU 101 controls activation of a solenoid and a motor via a driver and a motor driver, and acquires sensor information of a sensor in the apparatus from an interface. Moreover, according to a controlling object or a sensor, the CPU 101 controls activation of a motor by a motor driver via the I/O interface 102, and acquires sensor information from a sensor. Incidentally, the CPU 101 executes the control in such a manner that the CPU 101 reads a program code stored in a read-only memory (ROM) (not shown), and loads the program code into a random access memory (RAM) (not shown), and then executes the control on the basis of a computer program defined by the program code by using the RAM as a work area and a data buffer.

Figure 14:
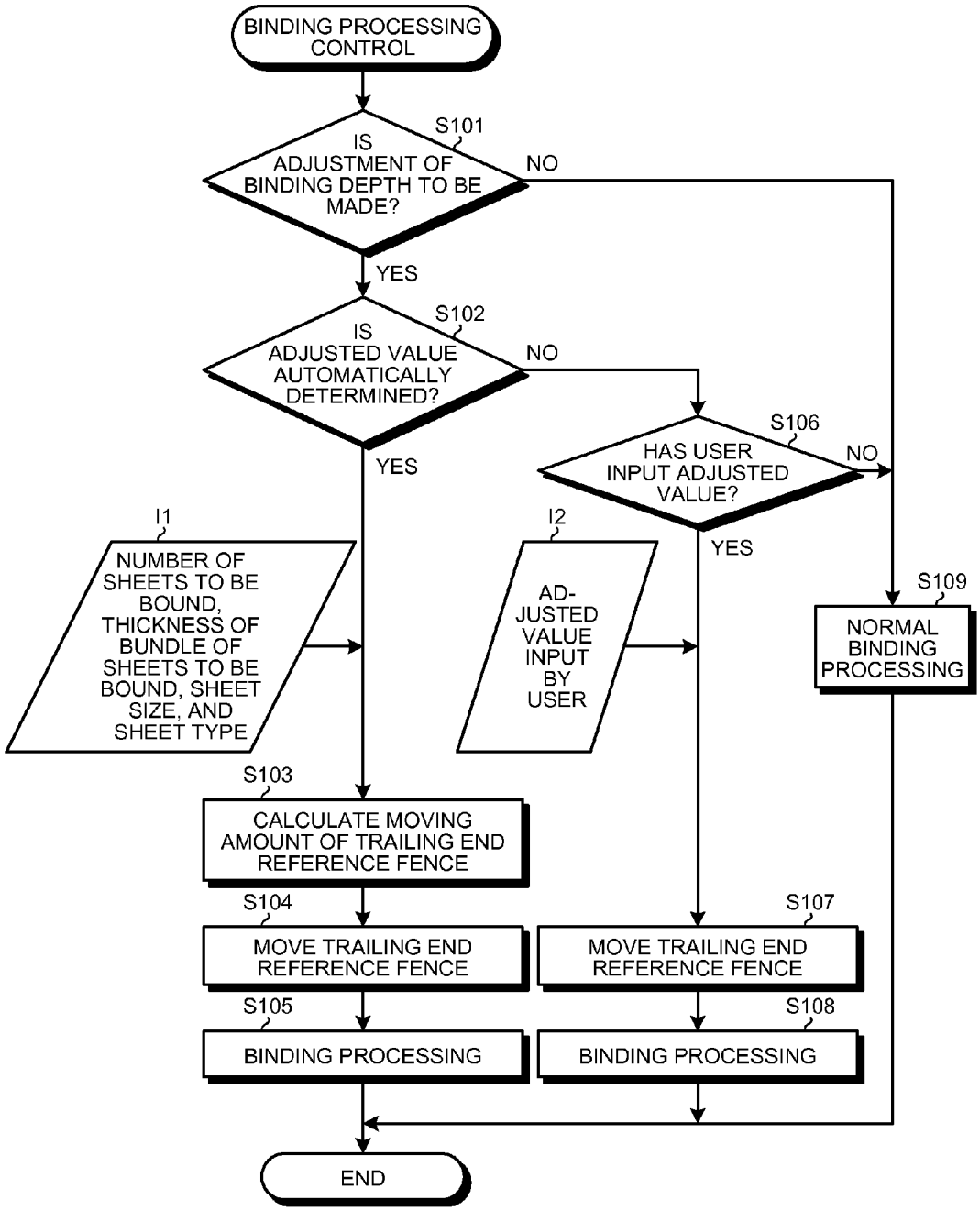
FIG. 14 is a flowchart illustrating a processing procedure for setting the binding depth in the conveying direction executed in the sheet post-processing apparatus having the mechanism illustrated in FIG. 9.

Furthermore, control of the sheet post-processing apparatus PD in FIG. 14 is executed on the basis of an instruction or information from the CPU of the image forming apparatus PR. A user's operation instruction is made through the operation panel 105 of the image forming apparatus PR. The image forming apparatus PR and the operation panel 105 are interconnected via a communication interface 106. Therefore, an operation signal from the operation panel 105 is transmitted from the image forming apparatus PR to the sheet post-processing apparatus PD, and information on a processing state or function of the sheet post-processing apparatus PD is notified to a user or an operator through the operation panel 105. Therefore, through the operation panel 105 of the image forming apparatus PR, a user can arbitrarily set the binding depth in the conveying direction according to a type of binding (front-side binding/back-side binding/2-point binding, side binding/diagonal binding) and a type of sheet (coated paper, cardboard, and the like). Furthermore, taking advantage of the conveying direction movable configuration, the sheet post-processing apparatus PD can have a mode in which a service person makes a fine adjustment of the binding position.

FIG. 14 is a flowchart illustrating a processing procedure for setting of the binding depth, in the conveying direction, executed in the sheet post-processing apparatus PD having the mechanism illustrated in FIG. 9, and this processing is executed by the CPU 101 of the sheet post-processing apparatus PD. In this processing procedure, it is first checked whether or not an adjustment of the binding depth is to be made (Step S101). When the adjustment of the binding depth is not made (NO at Step S101), normal binding processing using the default binding depth is performed (Step S109).

On the other hand, when the adjustment of the binding depth is made (YES at Step S101), i.e., when a user selects the adjustment of the binding depth through the operation panel 105, it is further checked whether an adjusted value of the binding depth is to be automatically determined (Step S102). When an adjusted value is automatically determined (YES at Step S102), information on a number of sheets to be bound, thickness of a bundle of sheets to be bound, sheet size, and a type of sheet (information I1) is acquired from the CPU of the image forming apparatus PR. Although all the above four pieces of information is normally acquired, when at least one piece of information is acquired, a process at Step S103 is performed on the basis of the information. Incidentally, in the present embodiment, a type of sheet means the thickness of sheet (cardboard, plain paper, thin paper, and the like) and a type of special paper such as coated paper.

Then, the CPU 101 of the sheet post-processing apparatus PD calculates a moving amount of the trailing end reference fences 51*a* and 51*b* on the basis of the acquired information I1 (Step S103), drives the conveying direction fence drive motor 50*i* and moves the trailing end reference fences 51*a* and 51*b* by the calculated moving amount (Step S104), and then executes binding processing (Step S105).

At Step S102, when the adjusted value is not automatically determined (NO at Step S102), it is checked whether a user has input an adjusted value (Step S106). When a user has input an adjusted value, the adjusted value d that the user has input through the operation panel 105 of the image forming apparatus PR (information I2; see FIGS. 15A and 15B) is acquired, and the conveying direction fence drive motor 50*i* is driven to move the trailing end reference fences 51*a* and 51*b* by a calculated moving amount (Step S107), and then binding processing is executed (Step S108). By performing this processing, the binding depth (the binding position from the sheet trailing end) can be set to an arbitrary and appropriate position to perform the binding process.

Figure 15A:
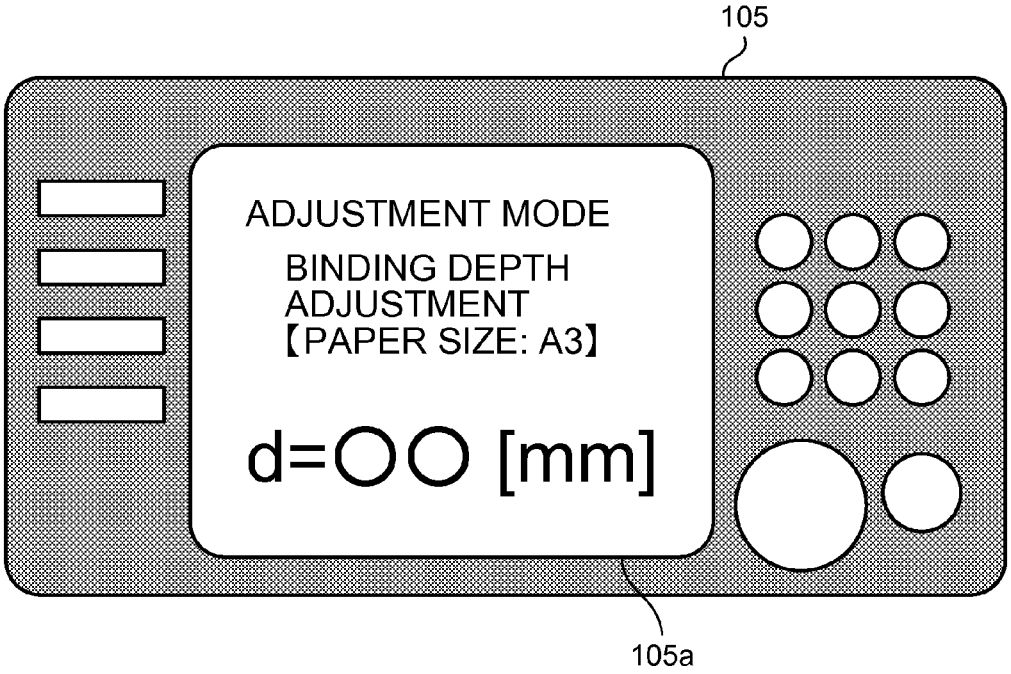
FIGS. 15A and 15B are diagrams for explaining, respectively, a display screen on which information input by a user is displayed and an adjusted value.
Figure 15B:
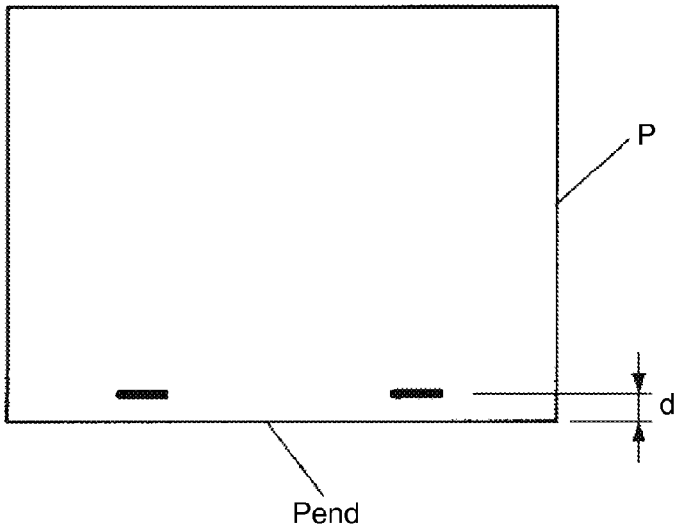

FIGS. 15A and 15B are diagrams for explaining a display screen on which the information I2 is displayed and the adjusted value d; FIG. 15A shows a display state of the operation panel, and FIG. 15B shows the adjusted value d. Namely, if an adjusted value has been input at Step S106 in FIG. 14, as illustrated on a liquid crystal display screen 105*a* in FIG. 15A, the input adjusted value d is displayed together with the sheet size. In this example, the adjusted value d indicates that the binding depth is d millimeters away from the trailing end Pend on the long side of an A3 size sheet.

Incidentally, when the adjusted value d is changed, an adjusted value is input through an adjusted-value input screen (not shown) on the operation panel 105 through a numerical keypad. In response to this, the processes subsequent to Step S101 are repeated, and an adjustment of the binding position is made.

As described above, according to the present embodiment, following effects can be expected.

(1) It is possible to adjust the binding position (binding depth) in the sheet-conveying direction in edge binding processing to a position that an individual user intends to set.

(2) In the conventional technologies, a mechanism for retracting the trailing end reference fences 51*a* and 51*b* and a sheet-bundle conveying unit for delivering a sheet bundle to the ejection claw 52*a* needs to be provided additionally because the edge-binding stapler S1 has to be configured to be movable in the sheet width direction (the direction perpendicular to the conveying direction), so that the trailing end reference fences 51 or the ejection claw 52*a* cannot be provided in a moving range of the stapler S1; however, in the present embodiment, the trailing end reference fence 51*a* is configured to be movable in the sheet conveying direction, so that it is possible to lift up a sheet bundle SB to a position where the sheet bundle SB is delivered to the ejection claw 52*a*, and the trailing end reference fence 51*a* can also function as the sheet-bundle conveying unit. Therefore, it is possible to downsize an apparatus and to reduce a production cost.

(3) When a user inputs a position of the binding depth, sheet size information and sheet type information are acquired from the image forming apparatus PR, and a moving amount of the trailing end fences 51*a* and 51*b* is calculated from these information and the depth position that has been input; therefore, it is possible to bind a sheet bundle at an intended position by moving the trailing end fences 51*a* and 51*b* for an appropriate moving amount.

Second Embodiment

In a second embodiment, a stapling unit is configured to be movable in a sheet conveying direction with respect to a trailing end reference fence that supports a trailing end of a sheet bundle, so that a binding position (binding depth) of the sheet bundle on a staple tray in the sheet conveying direction in edge binding processing can be arbitrarily adjusted to a position that an individual user intends to set. Hereinafter, the stapling unit having a different mechanism from that in the first embodiment is explained. Incidentally, because elements other than the stapling unit have the same configurations as those in the first embodiment, repeated descriptions thereof are omitted.

Figure 16:
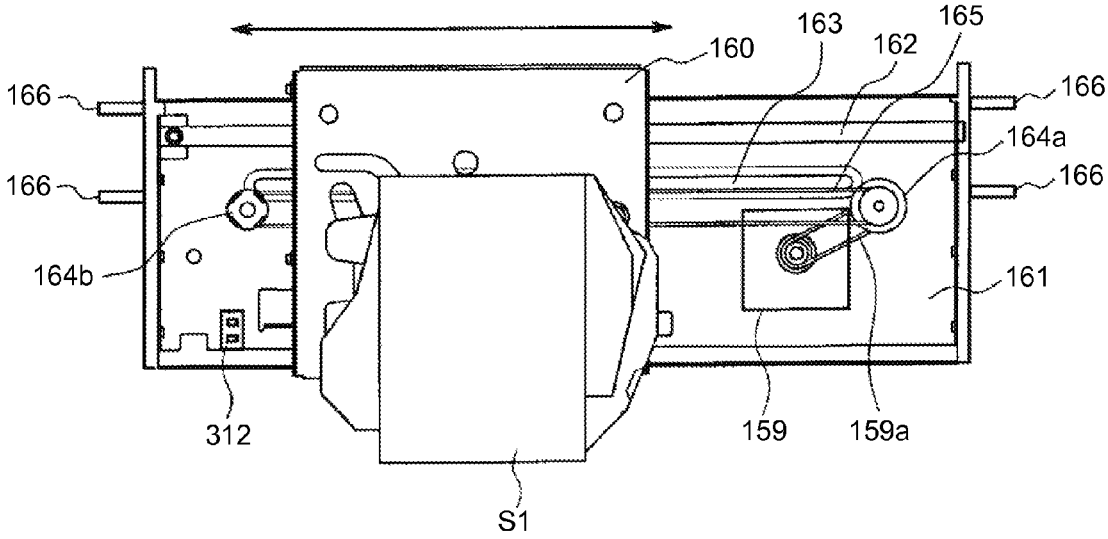
FIG. 16 is a perspective view illustrating a moving mechanism of a stapler according to a second embodiment.

FIG. 16 is a side view illustrating a width-direction moving mechanism of a stapler according to the second embodiment. As shown in FIG. 16, in the edge-binding stapler 51, a slide base 160 is provided to be movable in directions indicated by a two-headed arrow along a slide shaft 162 provided on a base 161 and a slide groove 163 formed on the base 161. The stapler moving motor 159 capable of rotating in a forward and reverse directions and a pair of pulleys are provided on the base 161, and the slide base is attached to a timing belt 165 suspended between pulleys 164*a* and 164*b*. Furthermore, the pulley 164*a* suspends the timing belt 159*a* for transmitting driving force from a drive shaft of the stapler moving motor 159, and transmits the driving force of the stapler moving motor 159 to the timing belt 159*a*, and the slide base 160, on which the edge-binding stapler S1 is mounted, moves in the sheet width direction so as to bind the trailing end of a sheet bundle at a predetermined position. At one end of a moving range of the slide base 160, the stapler moving HP sensor 312 for detecting a home position of the edge-binding stapler S1 is provided, and the binding position in the sheet width direction is controlled according to a moving amount of the edge-binding stapler S1 from the home position. The edge-binding stapler S1 is configured to staple the trailing end of a sheet bundle at one point or a plurality of points (generally, two points), and is movable at least across the full width of the trailing end ST of a sheet bundle supported by the trailing end reference fences 51*a* and 51*b*. Furthermore, for replenishment of staples, the edge-binding stapler S1 is configured to be maximally movable to the front side of the apparatus so as to make it easy for a user to perform the staple replenishing operation.

As will be described later, the base 161 is movable in the sheet conveying direction, and a pair of projections 166 to be freely fitted in a slide groove for moving the base 161 in the sheet conveying direction projects from each of the side surfaces of the base 161.

Figure 17:
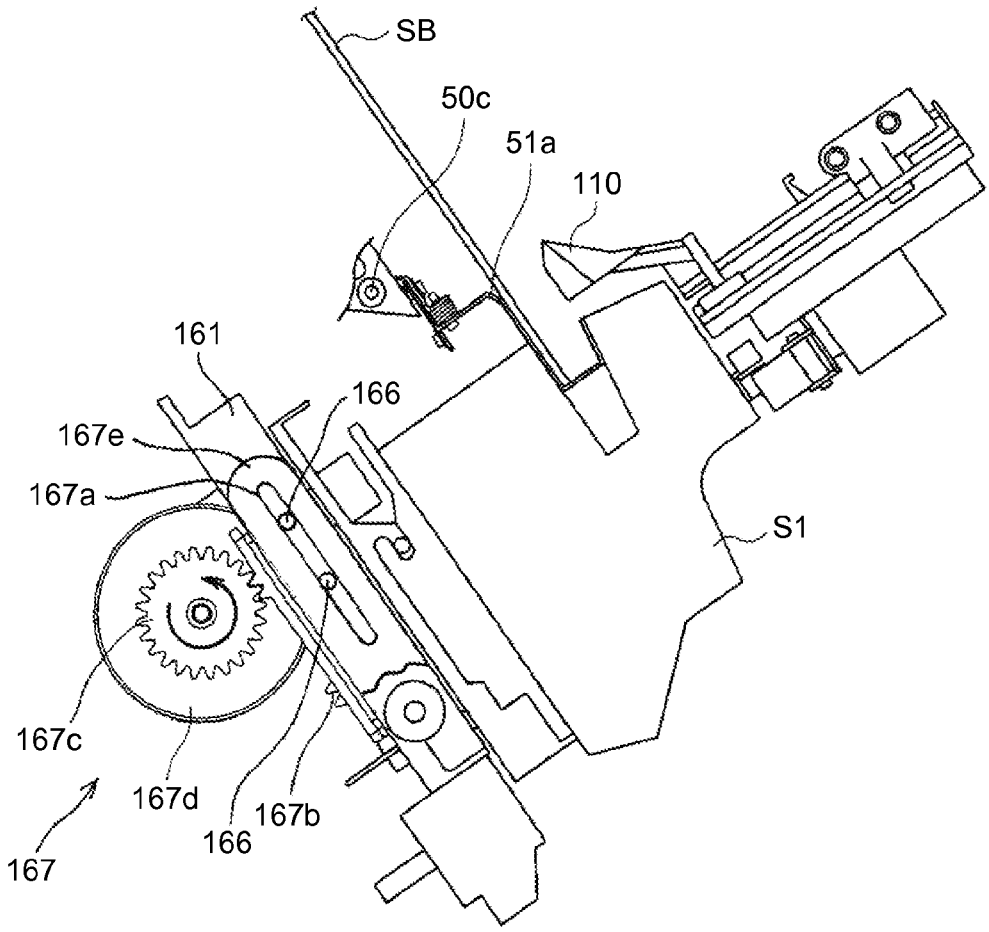
FIG. 17 is an explanatory diagram illustrating an example of a mechanism for moving the trailing end reference fence in the sheet conveying direction according to a second embodiment and the operation of the moving mechanism.

FIG. 17 is an explanatory diagram illustrating an example of a mechanism 55 for moving the trailing end reference fence 51 in the sheet conveying direction (hereinafter, referred to as the "conveying direction moving mechanism 55") according to the second embodiment and the operation of the conveying direction moving mechanism 55.

In FIG. 17, a conveying direction moving mechanism 167 of the edge-binding stapler S1 includes a slide groove 167*a*, a rack 167*b*, a pinion 167*c*, and a stapler drive motor 167*d* for moving the edge-binding stapler S1 in the conveying direction. The slide groove 167*a* is formed on a side plate 167*e* on the apparatus side to be parallel to the bottom plate (the sheet stack surface) of the edge binding tray F, and the pair of projections 166 projecting from each of the side surfaces of the base 161 is freely fitted in the slide groove 167*a*. This restricts the moving position of the base 161 and allows sliding movement of the base 161 in a direction parallel to the bottom plate of the edge binding tray F. The stapler drive motor 167*d* is provided on the side of the base 161.

This movement is accomplished by the pinion 167*c* to which driving force is transmitted from a rotating shaft of the stapler drive motor 167*d* and the rack 167*b* that is provided on the end face of the apparatus-side side plate 167*e* and that is engaged with the pinion 167*c*; when the stapler drive motor 167*d* rotates, the pinion 167*c* moves integrally with the base 161 with respect to the rack 167*b* in the stationary side. Although a slide shaft for guiding the motion of the base 161 in the sheet conveying direction is not illustrated in FIG. 17, the base 161 moves in the conveying direction together with the edge-binding stapler S1 in accordance with the rotation of the stapler moving motor 167*d*.

Incidentally, also in the present embodiment, in view of the controllability and the positional accuracy, a stepping motor is used for the stapler drive motor 167*d*. Furthermore, in the present embodiment, the stapler drive motor 167*d* is provided on the side of the base 161, and the rack 167*b* is provided on side plate of the apparatus side; however, even if the elements are provided in the opposite side, the edge-binding stapler 51 can be moved in the sheet conveying direction. In addition, moving the edge-binding stapler S1 in the sheet conveying direction by using a timing belt or a periodic mechanism, such as a cam or a link, concerns design matters, and elements are arbitrarily selected according to a configuration and size of the apparatus.

When a binding position in the conveying direction and a binding position in the width direction are set, the edge-binding stapler S1 is moved to the binding position in the width-direction, and binds a sheet bundle SB by causing the stitcher S1*a* to drive a staple Sid into the sheet bundle SB and the clincher S1*b* to bend the tips of the staple Sid. Then, upon completion of the binding process, the edge-binding stapler S1 returns to a home position and waits for the next action, and the sheet bundle SB is discharged from the edge-binding stapler F by the ejection claw 52*a* in accordance with the rotation of the ejection belt 52.

In this manner, the positions of the trailing end reference fences 51*a* and 51*b* in the sheet width direction are set by the fence drive motor 503*d*3, and the position of the edge-binding stapler S1 in the sheet conveying direction is set by the stapler drive motor 167*d*. Incidentally, the position of a sheet S in the width direction is changed according to the sheet size and the stapling position in the width direction, and the position of the sheet S in the conveying direction is changed according to a set amount of a binding position from the sheet trailing end ST. Incidentally, the conveying direction moving mechanism 167 is not a portion that is frequently required to run; therefore, preferably, the conveying direction moving mechanism 167 is configured to include, for example, a worm gear incapable of driving backward or a mechanical holding mechanism, thereby to minimize power necessary for driving the conveying direction moving mechanism 167.

Figure 18:
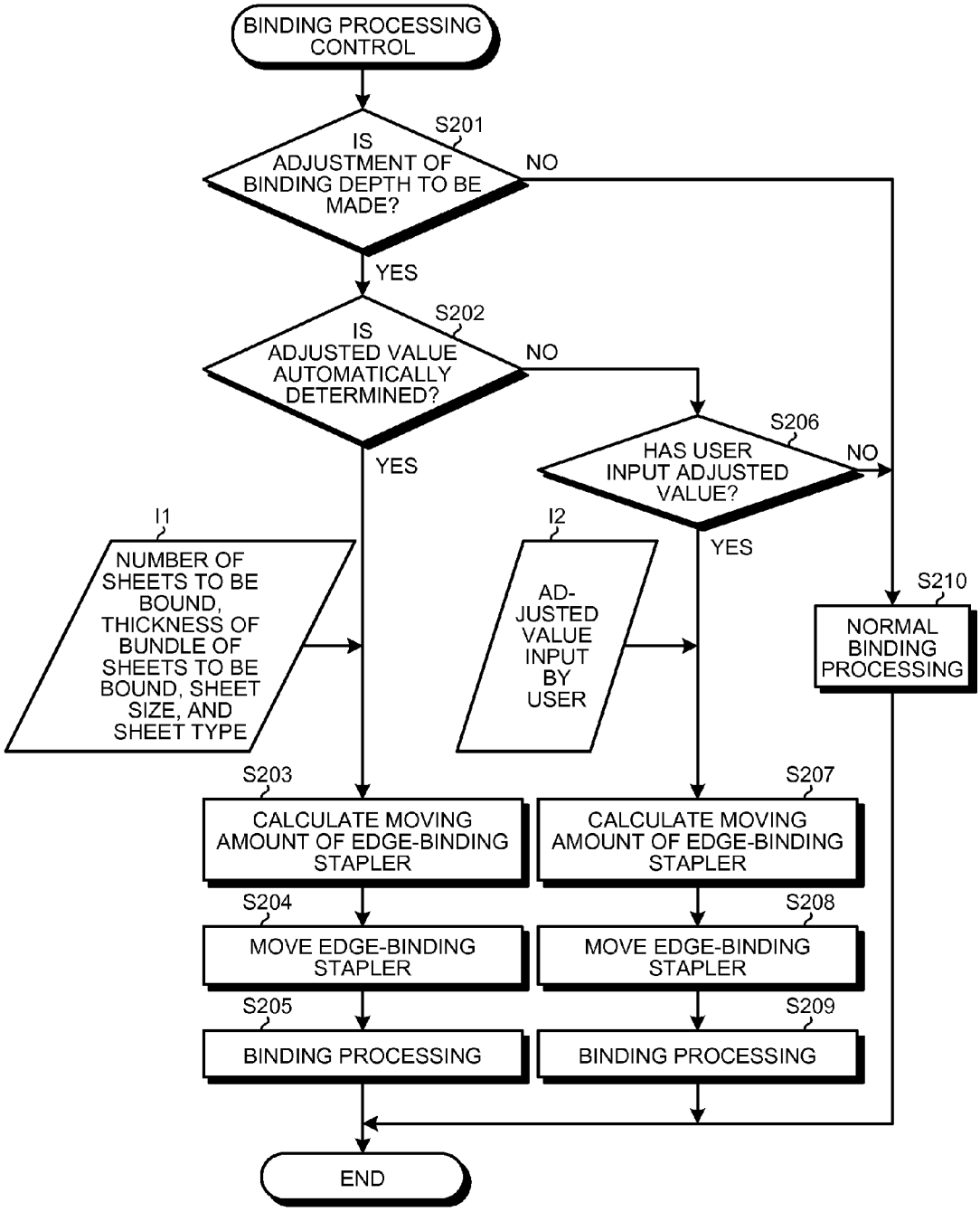
FIG. 18 is a flowchart illustrating a processing procedure for setting the binding depth in the conveying direction executed in the sheet post-processing apparatus having the mechanism illustrated in FIG. 13.

FIG. 18 is a flowchart illustrating a processing procedure for setting the binding depth in the conveying direction executed in the sheet post-processing apparatus PD having the mechanism illustrated in FIG. 17, and this process is performed by a CPU of the sheet post-processing apparatus PD (hereafter, referred to as a CPU_PD1) illustrated in FIG. 13. In this processing procedure, first, it is checked whether or not to make an adjustment of the binding depth (Step S201). When an adjustment of the binding depth is not made (NO at Step S201), a normal binding process using a default binding depth is performed (Step S210).

On the other hand, when an adjustment of the binding depth is made (YES at Step S201), i.e., when a user selects an adjustment of the binding depth through an operation panel PR1, it is further checked whether an adjusted value of the binding depth is to be automatically determined (Step S202). When an adjusted value is automatically determined (YES at Step S202), information on a number of sheets to be bound, thickness of a sheet bundle to be bound, sheet size, and a type of sheet (information I1) is acquired from the CPU of the image forming apparatus PR. Although all the above four pieces of information is normally acquired, when at least one piece of information is acquired, a process at Step S203 is performed on the basis of the information. Incidentally, in the present embodiment, a type of sheet means the thickness of sheet (cardboard, plain paper, thin paper, and the like) and a type of special paper such as coated paper.

Then, the CPU_PD1 of the sheet post-processing apparatus PD calculates a moving amount of the edge-binding stapler S1 on the basis of the acquired information I1 (Step S203), and drives the stapler drive motor 167*d* and moves the edge-binding stapler S1 by the calculated moving amount (Step S204), and then executes the binding process (Step S205). Therefore, a moving range of the edge-binding stapler S1 is at least on the back side of the sheet trailing end, i.e., on the upstream side in the conveying direction.

At Step S202, when an adjusted value is not automatically determined (NO at Step S202), it is checked whether a user has input an adjusted value (Step S206). When a user has input an adjusted value, the adjusted value d that the user has input through the operation panel 105 of the image forming apparatus PR (information I2; see FIGS. 15A and 15B) is acquired, and a moving amount of the edge-binding stapler S1 in the conveying direction is calculated (Step S207), and the stapler drive motor 167*d* is driven to move the edge-binding stapler S1 by the calculated moving amount (Step S208), and then the binding process is executed (Step S209). By performing this process, the binding depth (the binding position from the sheet trailing end) can be set to an arbitrary and appropriate position to perform the binding process.

As described above, according to the present embodiment, a user can set a moving amount in the sheet conveying direction and another moving amount in the direction perpendicular to the sheet conveying direction through the operation panel 105; therefore, it is possible to adjust the binding position (the binding depth) in the sheet conveying direction in edge binding processing to a position that an individual user intends to set.

According to the present embodiment, a sheet processing apparatus includes a moving unit that moves an aligning member for performing alignment of a sheet bundle in a sheet conveying direction in the sheet conveying direction depending on the binding depth of the sheet bundle to be bound by a binding unit; therefore, it is possible to provide a compact and inexpensive sheet processing apparatus capable of allowing each user to arbitrarily set the binding position from an end face of a sheet bundle.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing apparatus, comprising:

a sheet stacking unit on which sheets are accommodated and stacked as a sheet bundle;

an aligning member that is movable in a sheet width direction along a trailing end, and movable in a sheet conveying direction, of the sheet bundle stacked on the sheet stacking unit and that aligns the trailing end of the sheet bundle in the sheet conveying direction by abutting thereon;

a binding unit that moves along the trailing end of the sheet bundle in the sheet conveying direction and that binds the aligned sheet bundle; and a moving unit that moves the aligning member in the sheet conveying direction, wherein a distance from the trailing end of the sheet bundle in the sheet conveying direction to a binding position is adjustable by moving the aligning member in the sheet conveying direction.

2. The sheet processing apparatus according to claim 1, further comprising a conveying unit, configured to engage the trailing end of the sheet bundle, that conveys the sheet bundle stacked on the sheet stacking unit out of the sheet stacking unit, wherein the moving unit delivers the sheet bundle having been bound after adjusting the binding position to the conveying unit by moving the aligning member.

3. The sheet processing apparatus according to claim 2, wherein a moving range of the aligning member includes at least a position at which the sheet bundle can be delivered to the conveying unit.

4. The sheet processing apparatus according to claim 1, wherein a plurality of the aligning members is provided along the trailing end of the sheet bundle in the sheet conveying direction.

5. The sheet processing apparatus according to claim 4, further comprising a control unit that controls, through the moving unit, positions to which the aligning members are moved.

6. The sheet processing apparatus according to claim 5, wherein when the binding position is automatically set, the control unit calculates a moving amount of the aligning members based on at least one of a number of sheets bound in a sheet bundle, thickness of the sheet bundle, a size of sheet, and a type of sheet, thereby causing the moving unit to move the aligning members.

7. The sheet processing apparatus according to claim 5, wherein the control unit sets the binding position based on designation input from a user.

8. An image forming system comprising:

the sheet processing apparatus according to claim 1; and an image forming apparatus that includes an image forming unit for forming an image on a sheet.

9. An image forming system comprising:

the sheet processing apparatus according to claim 7; and an image forming apparatus that includes an image forming unit for forming an image on a sheet, wherein designation from the user is input through an operation panel of the image forming apparatus.

10. The sheet processing apparatus according to claim 1, wherein the sheet stacking unit includes a sheet ejection belt rotatable in the sheet conveying direction, the sheet ejection belt extending upstream of the aligning member.

11. A sheet processing apparatus comprising:

a sheet stacking unit on which sheets are accommodated and stacked;

a binding unit that is movable in a direction perpendicular to a sheet conveying direction and binds a bundle of sheets at a predetermined binding position;

an aligning unit movable in a sheet width direction and a sheet conveying direction and that aligns the sheets stacked on the sheet stacking unit in the sheet conveying direction; and a moving unit that adjustably moves, in the sheet conveying direction, the binding position by the binding unit with respect to an aligning position by the aligning unit.

12. A sheet processing method, comprising:

discharging sheets onto a sheet stacking unit and stacking the sheets on the sheet stacking unit as a sheet bundle;

moving an aligning member that aligns trailing ends of the sheets in a sheet conveying direction by abutting thereon along a trailing end, in the sheet conveying direction, of the sheet bundle stacked on the sheet stacking unit;

binding a sheet bundle, for which alignment in a sheet conveying direction and in a direction perpendicular to the sheet conveying direction has been completed, at an intended position by moving a sheet binding unit along the trailing end, in the sheet conveying direction, of the sheet bundle;

aligning the trailing ends of the sheets with an ejection device by rotating an ejection belt in a direction toward the ejection device; and adjusting a distance from the trailing end of the sheet bundle in the sheet conveying direction to a binding position by moving the aligning member in the sheet conveying direction.

* * * * *